US007871153B2

(12) United States Patent
Hayashi

(10) Patent No.: US 7,871,153 B2
(45) Date of Patent: Jan. 18, 2011

(54) LIQUID JET HEAD, METHOD OF MANUFACTURING LIQUID JET HEAD, AND IMAGE FORMING APPARATUS

(75) Inventor: Keisuke Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 829 days.

(21) Appl. No.: 11/805,203

(22) Filed: May 21, 2007

(65) Prior Publication Data

US 2007/0291084 A1 Dec. 20, 2007

(30) Foreign Application Priority Data

May 26, 2006 (JP) ..... 2006-146140
Feb. 19, 2007 (JP) ..... 2007-038618

(51) Int. Cl.
*B41J 2/045* (2006.01)

(52) U.S. Cl. ..... 347/70

(58) Field of Classification Search ..... 347/68–72
See application file for complete search history.

(56) References Cited

U.S. PATENT DOCUMENTS 5,818,482 A 10/1998 Ohta et al.
6,161,925 A 12/2000 Reinten et al.

FOREIGN PATENT DOCUMENTS

EP 0819524 A1 1/1998
EP 1070589 A2 1/2001
JP 8-142325 6/1996
JP 9-277534 10/1997
JP 10-24587 1/1998
JP 2000-351217 12/2000
JP 3156411 2/2001
JP 3175449 4/2001
JP 2003-250281 9/2003
JP 2003-266711 9/2003
JP 2004-160952 6/2004
JP 2006-175845 7/2006
JP 2007-76264 3/2007

OTHER PUBLICATIONS

Sep. 11, 2007 European search report in connection with corresponding European patent application No. EP 07 25 2038.

*Primary Examiner*—An H Do
(74) *Attorney, Agent, or Firm*—Cooper & Dunham LLP

(57) ABSTRACT

A disclosed liquid jet head includes a nozzle plate having plural nozzles for jetting liquid therefrom, plural flowpaths formed in communication with the plural nozzles, a vibration plate member having a flexible part that forms at least one of the walls of each flowpath, and plural piezoelectric element units having a piezoelectric element member fixed to a base member. Each piezoelectric element unit has plural piezoelectric elements divided by a plurality of slits formed in the piezoelectric element member. The plural piezoelectric element units are arranged in a straight line at predetermined intervals along the plural nozzles.

16 Claims, 20 Drawing Sheets

(a)
(b)
Lpa
Lb
13
14
BONDING
(c)
13
14
CUTTING
(d)
13
14
Lp
(e)
13
14
TO FIG.20

LIQUID JET HEAD, METHOD OF MANUFACTURING LIQUID JET HEAD, AND IMAGE FORMING APPARATUS

BACKGROUND OF THE INVENTION

1. Technical Field

This disclosure relates to a liquid jet head, a method of manufacturing a liquid jet head, and an image forming apparatus.

2. Description of the Related Art

Typically, an image forming apparatus (multi-function machine), which has one or more of the functions of a printer, a facsimile machine, or a copier, forms images (image forming) by conveying a medium (hereinafter also referred to as "sheet" or "paper") and jetting a liquid (hereinafter also referred to as "recording liquid" or "ink") onto the conveyed paper by using a liquid jetting apparatus having a recording head (including one or more liquid jet heads) from which liquid (ink) droplets are ejected (jetted). It is to be noted that, although the medium is hereinafter referred to as "sheet" or "paper", the material of the medium is not to be limited only to those used for manufacturing paper. The medium may include, for example, a paper material, a textile material, a fiber material, a fabric material, a leather material, a metal material, a plastic material, a glass material, a wood material, or a ceramic material. The medium may be, for example, a recording medium (recording paper) or a transfer material (transfer paper). It is to be noted that "image forming" has substantially the same meaning as "recording" or "printing". For example, "image forming" includes forming images having meaning (e.g. characters, figures, symbols) and also image having no particular meaning (e.g. patterns). Furthermore, the liquid jetting apparatus is for jetting liquid from its liquid jet head and is not limited to an apparatus used for forming images.

One example of the liquid jet head is a piezoelectric type head using a piezoelectric actuator. The piezoelectric type head has a pressure generating part (actuator part) serving as a piezoelectric element for generating pressure to be applied to the liquid (ink) inside a liquid chamber (ink chamber). More specifically, the piezoelectric type head uses layered (laminated) type piezoelectric elements (d33, d31) having a piezoelectric layer and an internal electrode alternately layered on each other. The piezoelectric type head jets liquid droplets by changing the volume/pressure inside its liquid chamber. The volume/pressure inside the liquid chamber is changed by changing the shape of a flexible vibration plate that forms the wall of the liquid chamber. The shape of the vibration plate is changed by displacing the orientation of the layered type piezoelectric elements (d33, d31).

One example of such liquid jet head using layered type piezoelectric elements is disclosed in Japanese Laid-Open Patent Application 8-142325. The layered type piezoelectric element (driving element block) has a piezoelectric layer and an internal electrode layered alternately and an external electrode (individual side) and another external electrode (common side) formed on both ends. Plural driving parts (driving channels) and non-driving parts (on each side) are formed by performing a groove process on the layered type piezoelectric element while leaving a portion thereof remaining. With such configuration, the liquid in the liquid chamber is pressurized by displacing the layered type piezoelectric element d31. Furthermore, a common electrode of the layered type piezoelectric element is removed from the non-driving part on both sides with respect to a direction where the driving parts are arranged.

Furthermore, one example of a liquid jet head using the displacement of the direction of the layered type piezoelectric element d33 is disclosed in Japanese Laid-Open Patent Application No. 2003-250281. In this example, a groove process is performed on piezoelectric elements bonded to a top surface of a base, to thereby form plural piezoelectric elements corresponding to each liquid chamber having communicating nozzles.

Furthermore, Japanese Registered Patent No. 3156411 discloses a line type inkjet head having plural nozzles (opening parts) arranged on a single continuous nozzle plate. The inkjet head has plural piezoelectric elements arranged in correspondence with the nozzles by processing plural bulk piezoelectric members in which the process is performed at the borders of neighboring bulk piezoelectric members.

Furthermore, Japanese Laid-Open Patent Application No. 2000-351217 shows an example where plural liquid jet heads are connected together.

Furthermore, Japanese Laid-Open Patent Application No. 2003-266711 discloses plural head chips, which independently constitute a nozzle actuator, arranged in a line by bonding their sides together.

Furthermore, in Japanese Registered Patent No. 3175449, a head formed by bonding a piezoelectric member to a base member, performing a full-cut slitting process (forming slits reaching the base member), dividing the piezoelectric member into plural piezoelectric elements, and matching the ends of the base member parts.

Furthermore, Japanese Laid-Open Patent Application No. 9-277534 discloses a line type head using no piezoelectric element, and Japanese Laid-Open Patent Application No. 2004-160952 discloses an image forming apparatus having a typical line type head.

Meanwhile, in recent years and continuing, there is a demand for image forming apparatuses (e.g., inkjet recording apparatus) having high speed printing performance. One method of responding to such demand is to increase droplet jetting frequency. However, with this method, such increase of droplet jetting frequency requires a carriage that can correspondingly move at high speed. Thus, a powerful motor is required to be precisely controlled for stably jetting droplets at high frequency.

Another method is to fabricate a line head by extending the length of the head and increasing the number of nozzles provided in the head. However, in order to increase the entire length of the head (such as the above-described head shown in Japanese Laid-Open Patent Application Nos. 8-142325 and 2003-250281), the length of each component constituting the head is to be increased. From the aspects of manufacturing and handling, it is particularly difficult to increase the length of thin long piezoelectric components, such as a lead-zirconate-titanate piezoelectric element.

Although the above-described Japanese Registered Patent No. 3156411 discloses a head having a line type configuration, a piezoelectric element having such configuration is liable to collapse or be chipped away since the piezoelectric element is fabricated by dividing a bulk piezoelectric member. Furthermore, the poor yield of the piezoelectric element increases manufacturing cost.

Furthermore, a line type head having plural liquid jetting heads connected together such as the one shown in the above-described Japanese Laid-Open Patent Application No. 2000-351217 causes the overall size of the head to be considerably large. Such oversized head results in increasing the size of the image forming apparatus.

Furthermore, with the head having plural head chips independently constituting a nozzle actuator by bonding their sides together (as shown in the above-described Japanese Laid-Open Patent Application No. 2003-266711), it becomes difficult, for example, to control the thickness of the adhesive agent layer when attempting to obtain a higher density.

Furthermore, with the head formed by bonding a piezoelectric member to a base member, performing a full-cut slitting process (forming slits reaching the base member), dividing the piezoelectric member into plural piezoelectric elements, and matching the ends of the base member parts (as shown in Japanese Registered Patent No. 3175449), it is to difficult to provide a highly precise pitch between the piezoelectric elements of the adjacent ends of the base member parts.

BRIEF SUMMARY

In an aspect of this disclosure, there is provided a liquid jet head including: a nozzle plate having a plurality of nozzles for jetting liquid therefrom; a plurality of flowpaths formed in communication with the plural nozzles; a vibration plate member having a flexible part that forms at least one of the walls of each flowpath; and a plurality of piezoelectric element units having a piezoelectric element member fixed to a base member, each piezoelectric element unit having a plurality of piezoelectric elements divided by a plurality of slits formed in the piezoelectric element member; wherein the plural piezoelectric element units are arranged in a straight line at predetermined intervals along the plural nozzles.

In another aspect, there is provided a method of manufacturing a liquid jet head including the steps of: a) fixing a single piezoelectric element member onto a single base member; b) fabricating a plurality of piezoelectric element units by forming a plurality of piezoelectric elements by forming a plurality of slits in the piezoelectric element member; and c) fixing the plural piezoelectric element units to the vibration plate so that the intervals between the piezoelectric element members of adjacent piezoelectric element units is substantially equal to the width of the slit.

In another aspect, there is provided a liquid jetting apparatus for jetting liquid droplets from one or more liquid jet heads, the liquid jetting apparatus including: the aforementioned liquid jet head.

In another aspect, there is provided an image forming apparatus for forming images by jetting liquid droplets from a liquid jet head, the image forming apparatus including: the aforementioned liquid jet head.

In another aspect, there is provided a piezoelectric actuator including: a fixing member having a plurality of flexible parts; and a plurality of piezoelectric element units having a piezoelectric element member fixed to a base member, each piezoelectric element unit having a plurality of piezoelectric elements divided by a plurality of slits formed in the piezoelectric element member; wherein the plural piezoelectric element units are arranged in a straight line at predetermined intervals.

Other aspects, features and advantages will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
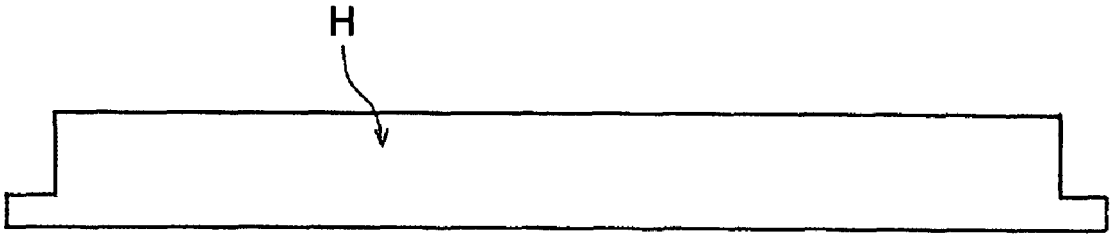
FIG. 1 is a side view showing a liquid jet head according to a first embodiment of the present invention.
Figure 2:
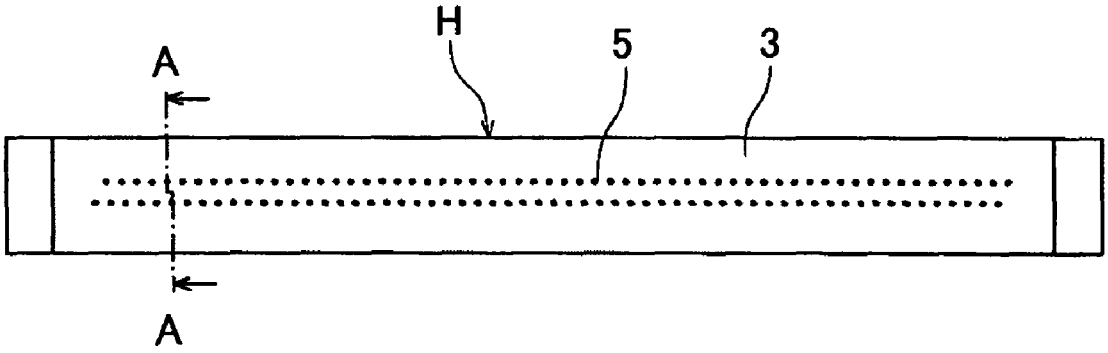
FIG. 2 is a plan view of the liquid jet head shown in FIG. 1.
Figure 3:
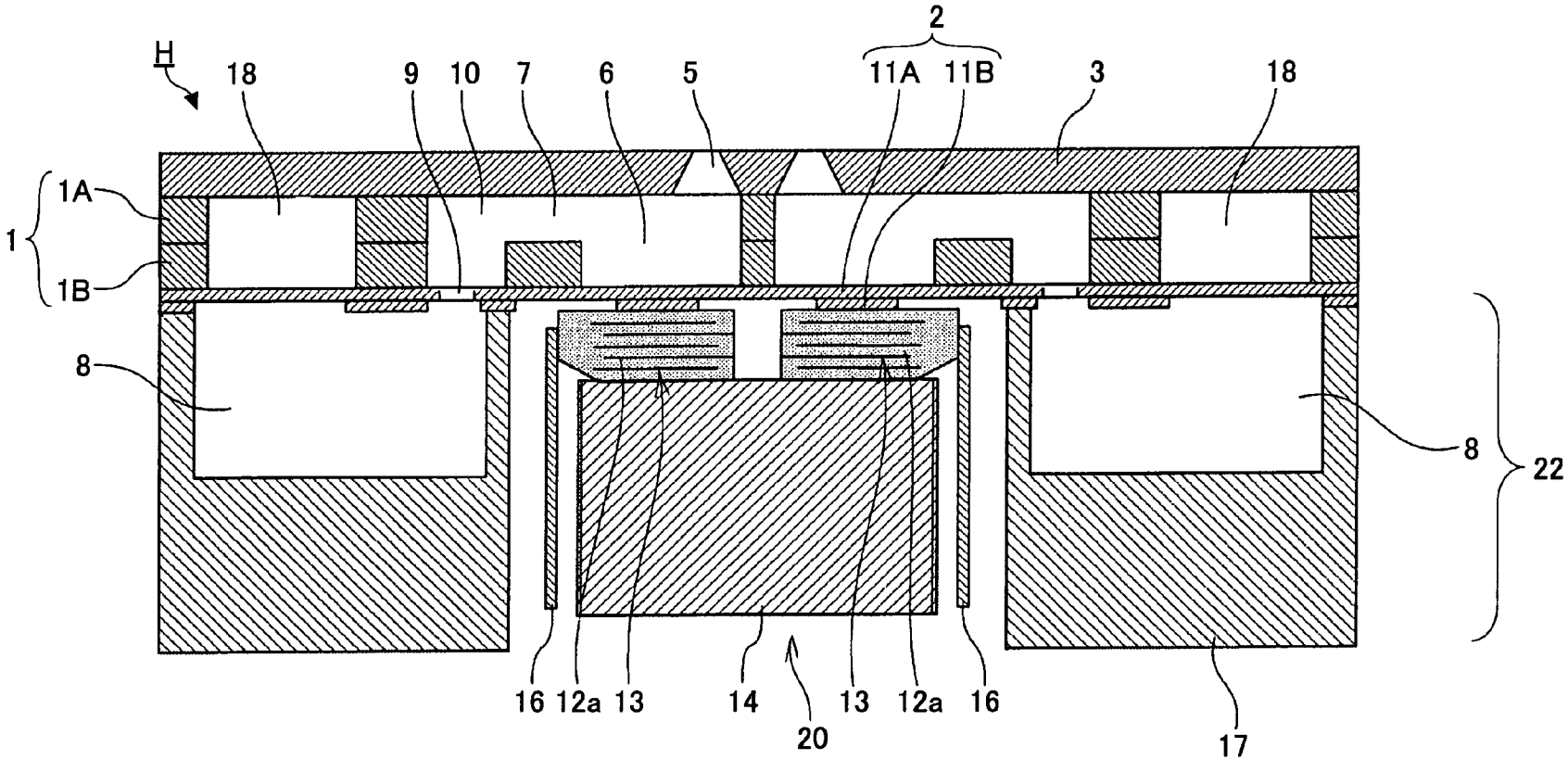
FIG. 3 is a cross-sectional view with respect to a longitudinal direction of a liquid chamber along line A-A of FIG. 2.
Figure 4:
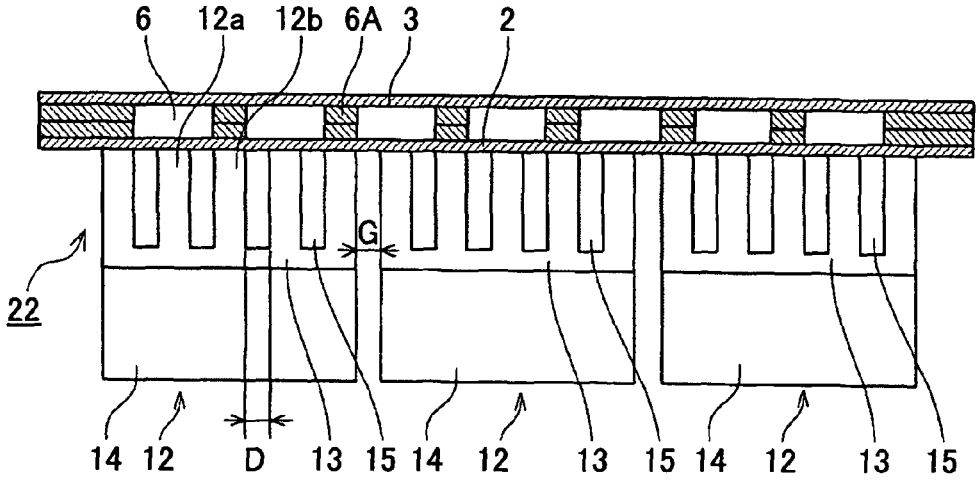
FIG. 4 is a cross-sectional view with respect to a transverse direction.
Figure 5:
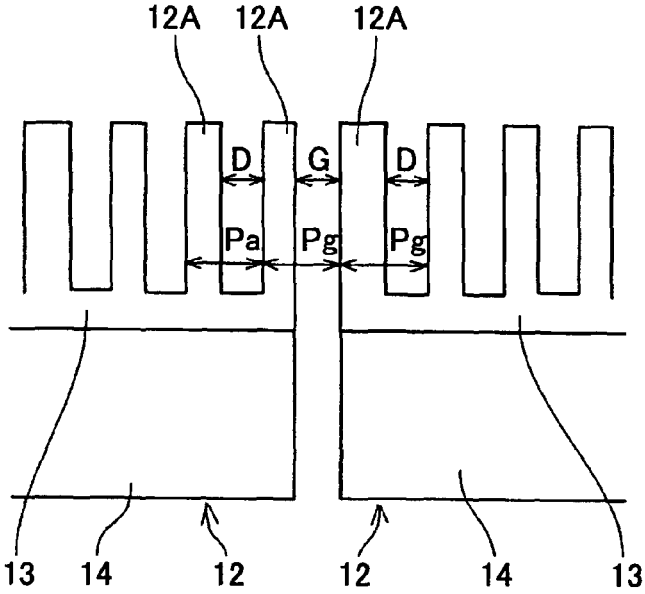
FIG. 5 is an enlarged view showing a portion o the cross-section of FIG. 4.
Figure 6:
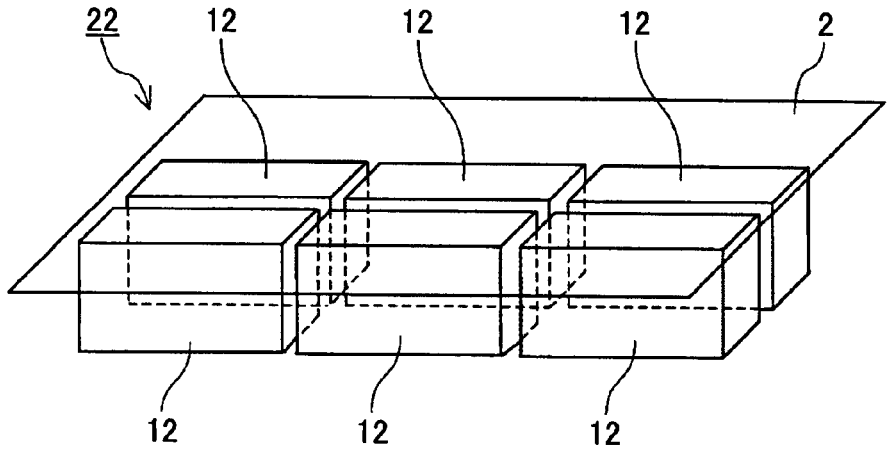
FIG. 6 is a perspective view showing a piezoelectric actuator according to an embodiment of the present invention.

First, a liquid jet head H according to a first embodiment of the present invention is described with reference to FIGS. 1 to 5. FIG. 1 is a side view of the liquid jet head H according to the first embodiment of the present invention. FIG. 2 is a plan view of the liquid jet head H according to the first embodiment of the present invention. FIG. 3 is a cross-sectional view with respect to a longitudinal direction of a liquid chamber (direction that perpendicularly intersects the direction in which nozzles are arranged) taken along line A-A of FIG. 2. FIG. 4 is a cross-sectional view with respect to a transverse direction of the liquid chamber (direction in which the nozzles are arranged). In FIG. 4, the cross sections of a piezoelectric element member 13 and a base member 14 are not illustrated in detail for the sake of convenience. FIG. 5 is an enlarged view for describing a portion of the configuration shown in FIG. 4. FIG. 6 is a perspective view for describing an actuator included in the liquid jet head H including an arrangement of piezoelectric element units according to an embodiment of the present invention.

The liquid jet head H according to an embodiment of the present invention includes a flow path substrate (also referred to as "flow path member" or "liquid chamber substrate") 1 formed of an SUS substrate, a vibration plate member 2 bonded to a bottom surface of the flow path substrate 1, and a nozzle plate 3 bonded to a top surface of the flow path substrate 1. The flow path substrate 1, the vibration plate member 2, and the nozzle plate 3 are used to form individual flow paths 6 (hereinafter also referred to as "pressurizing liquid chambers", "pressure chambers", "pressurizing chambers", or "pressure generating chambers"that are in communication with nozzles 5 from which liquid droplets are jetted (ejected), a fluid resistance part 7 including a supply path for supplying ink (recording liquid) to the pressurizing chamber 6, and a buffer chamber 18 for controlling the changes of pressure in a below-described common liquid chamber (shared liquid chamber).

The flow path substrate 1 includes a restrictor plate 1A and a chamber plate 1A that are adhered together. The openings of each pressurizing liquid chamber 6, fluid resistance part 7, and buffer chamber 18 may be formed, for example, by etching (e.g. etching a SUS substrate with an acidic etchant) or performing a mechanical processing technique (e.g. punching). It is to be noted that the fluid resistance part 7 is formed by forming an opening at a portion of the restrictor plate 1A and not forming an opening at a portion of the chamber plate 1B.

The vibration plate member 2 is bonded to the chamber plate 1B of the flow path substrate 1 with an adhesive agent. The vibration plate member 2 according to an embodiment of the present invention is formed by bonding a flexible area (diaphragm part) 11A provided in one of the walls of the pressurizing liquid chambers 6 to a protruding part 11B of a SUS substrate. The diaphragm part 11A may be formed of a resin material such as polyimide. Alternatively, a metal plate (e.g., nickel plate) may be used to form the vibration plate member 2.

The nozzle plate 3 is provided with a nozzle 5 (diameter ranging from 10 μm to 30 μm) corresponding to each pressurizing liquid chamber 6 and is bonded to the restrictor plate 1A of the flow path substrate 1 with an adhesive agent. Metal materials (e.g., stainless steel, nickel), resin materials (e.g., polyimide resin film), silicon material, or combinations thereof may used to form the nozzle plate 3. Various techniques (e.g., electroplating method, water repellant agent coating method) may be applied to a nozzle surface (surface towards the liquid jetting direction: jetting surface) so that the nozzle surface can attain a liquid repellant (water repellant) property with respect to liquid (ink).

Furthermore, plural piezoelectric element units 12 (in this example, three units), which are arranged in a straight line along the arrangement of nozzles 5, are formed on an outer surface (surface facing opposite direction with respect to pressurizing liquid chamber 6) of the vibration plate member 2. In this example, two rows of the piezoelectric element units 12 are provided as shown in FIG. 6.

The piezoelectric element unit 12 is formed by bonding a layered type piezoelectric element member 13 to a base member 14. The piezoelectric element unit 12 includes plural piezoelectric elements 12*a* and column parts 12*b* "also referred to as "piezoelectric element column 12A" when not differentiating the piezoelectric element 12*a* from the column part 12*b*"for changing the shape of the diaphragm part 2A of the vibration plate member 2. The piezoelectric element columns 12A are fabricated by performing a slitting process (groove process) on the layered type piezoelectric element member 13 in which plural slits 15 are formed by partly cutting (half-cut process) corresponding areas of the layered type piezoelectric element member 13. The piezoelectric elements 12*a* and column parts 12*b* for each piezoelectric element unit 12 are bonded to corresponding parts of the diaphragm part 2A of the vibration plate member 2 and a liquid chamber partition wall 6A with an adhesive agent. Thus, by bonding the piezoelectric element unit 12 to the vibration plate member 2 serving as a fixing member, a piezoelectric actuator 22 according to an embodiment of the present invention can be obtained.

The plural piezoelectric element units 12 are arranged so that the interval (space) G between the piezoelectric element members 13 of adjacent piezoelectric element units 12 are substantially equal to the width D of the slit 15 (G=D). This allows the piezoelectric element columns 12A to be arranged with an even pitch, thereby high image quality can be attained. Furthermore, by providing spaces between adjacent base members 14, the piezoelectric element units can be easily arranged. It is to be noted that the space between adjacent base members 14 does not necessarily have to be equal to interval (space) G.

In addition to arranging the piezoelectric element units 12 so that the slit width D and the space G are substantially equal (G=D), the piezoelectric element units 12 are arranged so that the pitch Pa between the slits 15 is substantially equal to the pitch pg between the slits 15 and the spaces G (Pa=Pg) as shown in FIG. 5. Thereby, the piezoelectric element columns 12A can be arranged with an even pitch more reliably. Thus, higher image quality can be attained.

As for the piezoelectric direction of the above-described piezoelectric element 12*a*, the ink in the pressurizing liquid chamber 6 can be pressurized using displacement in the d33 direction or displacement in the d31 direction. In this example, displacement in the d33 direction is used. Although the above-described piezoelectric element unit 12 has a bi-pitch configuration where the piezoelectric elements 12*a* and the column parts 12*b* are alternately arranged, the piezoelectric element unit 12 may have a normal pitch configuration where no column parts 12*b* are used, that is, all of the columns 12A are piezoelectric elements 12*a*. Furthermore, in a case of using the bi-pitch configuration, the nozzles may be arranged in a zigzag manner so that a high density head having relatively little mutual interference can be obtained.

Furthermore, as shown in FIG. 3, an FPC cable 16 is connected to one end surface of the piezoelectric element member 13 for applying a drive waveform to each piezoelectric element 12*a*. The FPC cable 16 includes plural driver ICs (not shown) for applying driving waveforms (electric signals) that drive each channel (corresponding to each pressurizing liquid chamber 6). By mounting plural driver ICs to the FPC cable 16, an electric signal can be set in correspondence with each driver IC. This allows varying disposition characteristics of the drive channel of each piezoelectric element 12*a* to be easily corrected.

Furthermore, a frame member 17 is bonded to the periphery of the vibration plate member 2 with an adhesive agent. The frame member 17 includes a common liquid chamber (shared liquid chamber) 8 for supplying ink from outside to the pressurizing liquid chamber 6. The common liquid chamber 8 is positioned on the opposite side with respect to the driver IC (not shown) having at least the base member 14 situated therebetween. The common liquid chamber 8 is in communication with the flow path 10, the fluid resistance part 7 and the pressurizing liquid chamber 6 via a through-hole 9 of the vibration plate member 2.

Since the above-described liquid jet head H according to an embodiment of the present invention provides a nozzle plate having plural liquid jetting nozzles, plural individual flow paths communicating with the nozzles, and a vibration plate member having a flexible portion serving as at least one of the walls of the individual flow paths and arranges plural piezoelectric element units (the piezoelectric element unit including a base member fixed to a piezoelectric element member having plural piezoelectric elements divided slits) in a straight line along the arrangement of the nozzles, the positions amongst the piezoelectric elements can be prevented from deviating. Furthermore, groove processed piezoelectric elements, which are relatively fragile, can be easily handled as a whole. Furthermore, a long length liquid jet head can be manufactured at a low cost.

Furthermore, since the present invention forms a piezoelectric unit by bonding each piezoelectric element member to a corresponding base member and aligns plural piezoelectric units along the arrangement of nozzles, it is easier and less expensive in dealing with a case where there is a defect in a piezoelectric unit compared to a method of bonding each of plural piezoelectric units to the same (shared) base member and performing the slitting process.

That is, although there is a method of bonding plural piezoelectric element members to a single base member and performing a slitting process on the plural piezoelectric element members bonded to the base member, the entire actuator part could become defective in a case where a defect (e.g., damage in one of the piezoelectric element members) is caused by, for example, the slitting process. This results in decrease of yield. Meanwhile, with the present invention, even if a defect (e.g., damage in one of the piezoelectric element members) is caused by, for example, the slitting process, only the corresponding piezoelectric element unit needs to be exchanged. This results in increase of yield.

Accordingly, in one example using the liquid jet head H having the above-described configuration, the piezoelectric element 12*a* contracts as the voltage applied to the piezoelectric element 12*a* is reduced to a voltage below a reference potential. Then, the volume of the pressure chamber 6 increases as the vibration plate member 2 is lowered. Thereby, ink (recording liquid) flows into the pressure chamber 6. Then, by increasing the voltage to be applied to the piezoelectric element 12*a*, the piezoelectric element 12*a* is extended in a layered direction and the vibration plate member 2 deforms (curves) toward the nozzle direction, to thereby reduce the volume of the pressure chamber 6. Accordingly, the recording liquid inside the pressure chamber 6 is pressurized so that droplets of the recording liquid are ejected from the nozzles 5.

Then, the vibration plate member 2 moves back to its initial position when the voltage applied to the piezoelectric element 12*a* is returned to reference potential. This causes the volume of the pressure chamber 6 to increase, to thereby create negative pressure. When the negative pressure is created, recording liquid is introduced into the pressure chamber 6 from the shared liquid chamber 8. After the nozzle 5 becomes stable in which vibration of its meniscus surface attenuates, the process proceeds to the next liquid jetting operation.

It is to be noted that the method of driving the liquid jet head H of the present invention is not limited to the above-described example (pull-push action). A pull action or a push action may be conducted by controlling the driving waveform.

Figure 28:
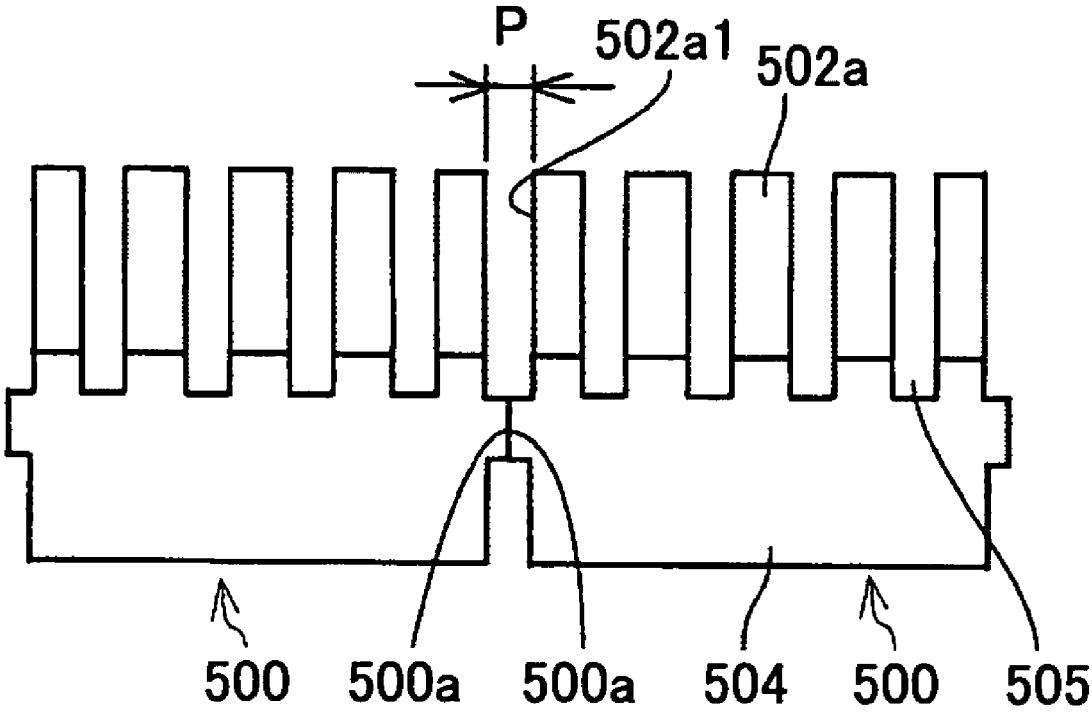
FIG. 28 is a schematic diagram for describing a piezoelectric element unit of a comparative example.

As described above, the piezoelectric element unit 12 of the liquid jet head H according to an embodiment of the present invention has a configuration including plural piezoelectric elements 12*a* formed by partly cutting (in this example, half-cut) a piezoelectric element member 13 and a base member 14 that is bonded to the piezoelectric element member 13. On the other hand, in a related art case (Japanese Patent Registration No. 3175449), a piezoelectric element member is bonded to a base member 504 and slits 505 are formed in the piezoelectric element member by conducting a slitting process (e.g., dicing) where the piezoelectric element member is cut to a depth reaching the base member 504 (full-cut), to thereby obtain a piezoelectric unit 500 having plural piezoelectric elements 502*a*. Thus, plural piezoelectric units 500 are arranged by matching the end faces 500*a* of one piezoelectric unit 500 to another piezoelectric unit 500 as shown in FIG. 28.

However, in such case of obtaining plural piezoelectric elements by fully cutting the piezoelectric element member bonded to the base member 504, the material of the base member 504 is limited to a material that can endure the slitting process (e.g., dicing). Furthermore, the material (adhesive agent) for bonding the piezoelectric element member and the base member 504 together is required to have a bonding strength that can endure the full-cut process. Accordingly, the related art case has various limitations from the aspects of, for example, the selectable material of the base member 504 or the adhesive strength of the bonding material.

Furthermore, in a case of arranging plural piezoelectric element units 500 having the base member 504 bonded to the fully cut piezoelectric element member with the related art case, the end parts of the base member 504 are required to be cut. Therefore, the base member 504 is required to protrude further outward compared to an outer end face (for example, outer end face 502*a*1 of FIG. 28) of the outermost piezoelectric element positioned at the end part of the plural piezoelectric elements 502*a*.

Meanwhile, the configuration of the piezoelectric element unit 12 of the liquid jet head H according to an embodiment of the present invention has an advantage in which the piezoelectric element member can be formed with a greater length than that of the base member (length of base member<length of piezoelectric element member) by bonding the base member to the partly cut (half-cut) piezoelectric element member.

In other words, in a case of the full cut configuration, the outermost piezoelectric element(s) positioned at the end part of plural piezoelectric elements is considerably unstable if the base member is formed having a short length. Thus, the full cut configuration is unreliable. In a case of the partly cut (half-cut) configuration, there is no significant difference even if the piezoelectric element member is longer than the base member to some degree owing that the entire bottom surface of the piezoelectric element member is fixed to the base member. Furthermore, since the piezoelectric element member can be formed with a length greater than that of the base member (length of base member<length of piezoelectric element member), the piezoelectric element member can be initially fabricated with rough measurements, bonded to the base member, and have its end parts cut off in a subsequent slitting process (e.g., dicing), thereby reliably and precisely matching specific measurements required for the piezoelectric element unit.

Furthermore, even in a case where the piezoelectric element member is formed with a length shorter than that of the base member (length of base member>length of piezoelectric element member), unlike the full-cut configuration, the partly cut (half-cut) configuration can attain the following advantage.

Figure 29:
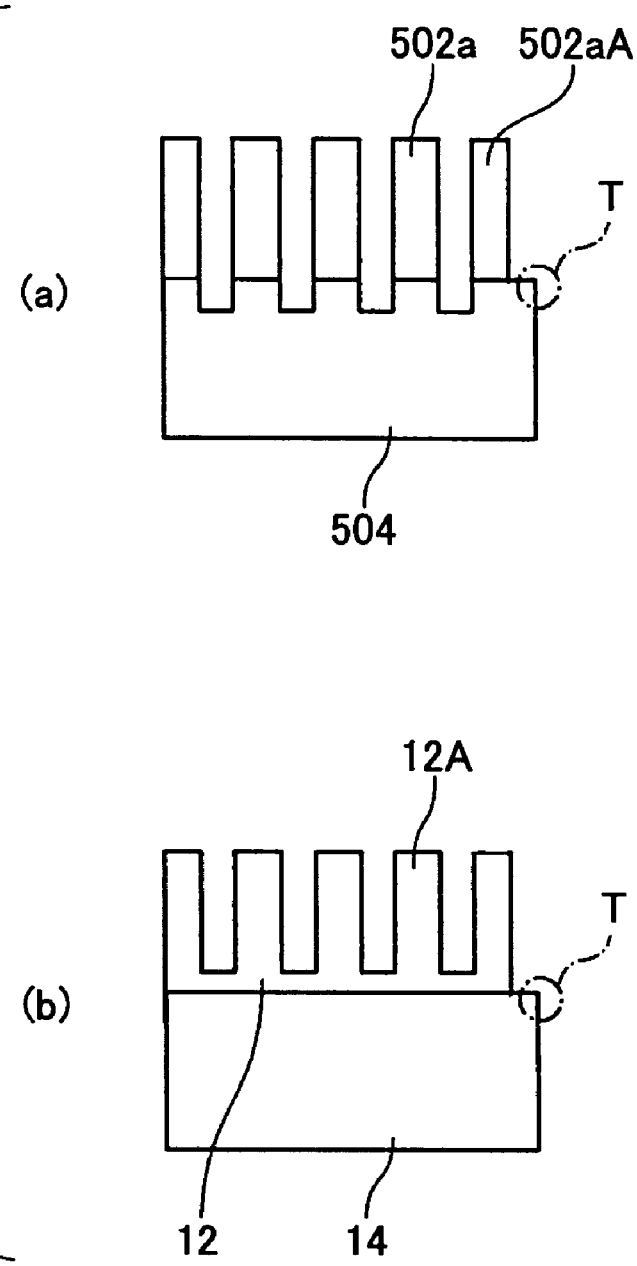
FIG. 29 is a schematic diagram for describing a comparison between a piezoelectric element unit of a comparative example and a piezoelectric element unit according to an embodiment of the present invention.

In the full-cut configuration shown in (a) of FIG. 29, it is necessary to perform a full-cut process on an end face situated at an outer area of the outermost piezoelectric element 502*a*A in order to maintain the fixed state between the outermost piezoelectric element 502*a*A and the base member 504 (It is necessary to remove a portion T shown in (a) of FIG. 29 for attaining the configuration shown in FIG. 28). In order to arrange plural actuators (piezoelectric element units), the side of a dicing blade is used to remove a portion of the base member 504 so that the end part of the base member 504 protrudes slightly outward. However, the cut target tends to deviate or bend with respect to the dicing blade, thereby making it extremely difficult to remove the portion of the base member 504. Although it is possible to initially fabricate the base member 504 with a large size and cut the base member 504 in a subsequent process, this requires an excessive amount of processes and results in shortening the life-span of the dicing blade.

On the other hand, with the partly cut (half-cut) configuration, plural piezoelectric element units can be arranged simply by controlling the bonding precision of the piezoelectric element member 12 and the base member 14 without having to remove the portion T of the base member 14, as shown in (b) of FIG. 29.

Furthermore, with a configuration having an end face 500*a* of a piezoelectric element unit 500 matched to the end face 5001 of another piezoelectric element unit 500 as shown in FIG. 28, the pitch P between the piezoelectric elements 502*a* is required to maintain a predetermined precision. In order to prevent an end face 500*a* of one piezoelectric element unit 500 from abutting an adjacent end face 500*a* of another piezoelectric element unit 500, the piezoelectric element member including the piezoelectric elements 502*a* and the base member 504 are required to be formed with high precision so that a predetermined distance between the outer end face 502*a*1 of the outermost piezoelectric element 502*a* and the end face 500*a* of the base member 500 can be obtained. However, this process is difficult to achieve.

On the other hand, with a configuration having plural piezoelectric elements 12*a* formed by partly cutting a piezoelectric element member 12 and bonding the piezoelectric element member 12 to a base member 14 according to an embodiment of the present invention (as shown in FIG. 28), less precision is required for forming the piezoelectric member 12 and the base material 14 since the predetermined pitch between the piezoelectric elements 12*a* is not obtained by matching the end faces between adjacent base members 14 but by matching the end faces between the piezoelectric element member 12 and the base member 14.

Figure 7:
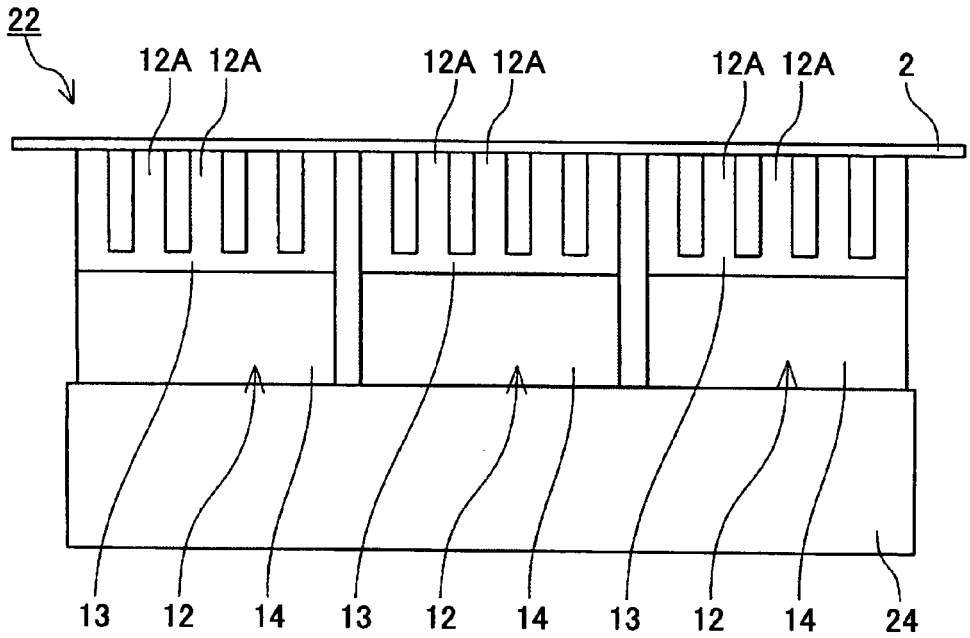
FIG. 7 is a schematic view showing a piezoelectric actuator of a liquid jet head according to a second embodiment of the present invention.

Next, a liquid jet head H according to a second embodiment of the present invention is described with reference to FIG. 7. FIG. 7 is a cross-sectional view with respect to a transverse direction of a liquid chamber of a piezoelectric actuator 22 of the liquid jet head H (direction that perpendicularly intersects the direction in which nozzles 5 are arranged).

In the piezoelectric actuator 22 of the liquid jet head H, the base members 14 of plural piezoelectric element units 12 are bonded to the same base member (shared base member) 24. In this example, the plural piezoelectric element units 12 are bonded to the shared base member 24 after completing the fabrication of the plural piezoelectric element units 12. After the plural piezoelectric element units 12 are bonded to the shared base member 24, the vibration plate member 2 is bonded to the piezoelectric elements 12*a* and the column parts 12*b* of the piezoelectric element units 12.

Accordingly, by fixing the base members 14 of the plural piezoelectric element units 12 to a single shared base member 24, a pseudo-configuration of a line actuator can be attained. Such configuration enables easy handling. Furthermore, the bonding process with respect to the vibration plate member 2 only needs to be performed once.

Figure 8:
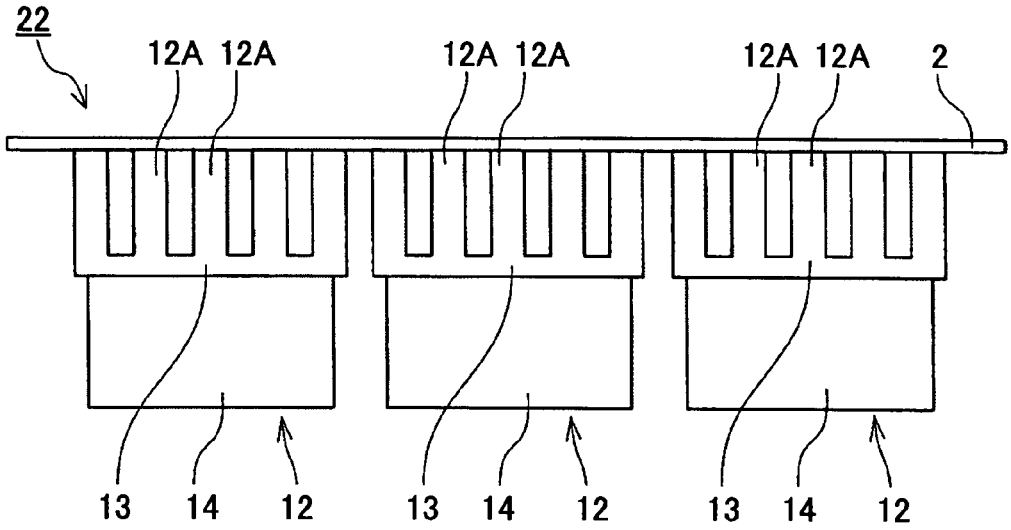
FIG. 8 is a schematic view showing a piezoelectric actuator of a liquid jet head according to a third embodiment of the present invention.
Figure 9:
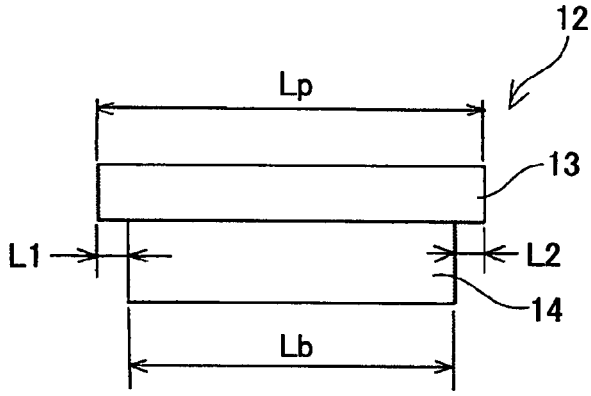
FIG. 9 is a schematic diagram for describing a piezoelectric element unit of a piezoelectric actuator according to an embodiment of the present invention.

Next, a liquid jet head H according to a third embodiment of the present invention is described with reference to FIGS. 8-9. FIG. 8 is a cross-sectional view with respect to a transverse direction of a liquid chamber of a piezoelectric actuator 22 of the liquid jet head H (direction perpendicularly intersecting with the direction in which nozzles 5 are arranged). FIG. 9 is a schematic diagram for describing the piezoelectric actuator 22 shown in FIG. 8.

As shown in FIG. 9, each piezoelectric element unit 12 of the piezoelectric actuator 22 includes a piezoelectric element member 13 having a length Lp (direction in which the piezoelectric element units 12 are arranged) that is equal to or greater than the length Lb of the base member 14 ($Lp \geqq Lb$). In this example, the piezoelectric element member 13 is formed with a length Lp greater than the length Lb of the base member 14 ($Lp > Lb$) so that the piezoelectric element member 13 protrudes from both ends of the base member 14.

By having the piezoelectric element member 13 protrude from the base member 14, the positions of each piezoelectric element unit 12 can be matched (by using optical imaging at the end parts of the piezoelectric element members 13) without having to consider abutting of adjacent base members 14.

Accordingly, position matching of the end parts of the piezoelectric element members 13 can be easily performed. Furthermore, the end parts of the piezoelectric element member 13 can be processed after the piezoelectric element member 13 is bonded to the base member 14. Thereby, the piezoelectric element unit 13 and its liquid jet head H can be fabricated with satisfactory measurements.

As shown in FIG. 9, in a case where the piezoelectric element columns 12A situated on both ends of the piezoelectric element member 13 are driven as piezoelectric elements 12*a*, it becomes easier to attain the same displacement characteristics for the piezoelectric elements 12*a* when the protruding distance (protruding amount) L1 of one end part of the piezoelectric element member 13 with respect to the base member 14 is substantially equal to the protruding distance (protruding amount) L2 of the other end part of the piezoelectric element member 13 with respect to the base member 14.

Figure 10:
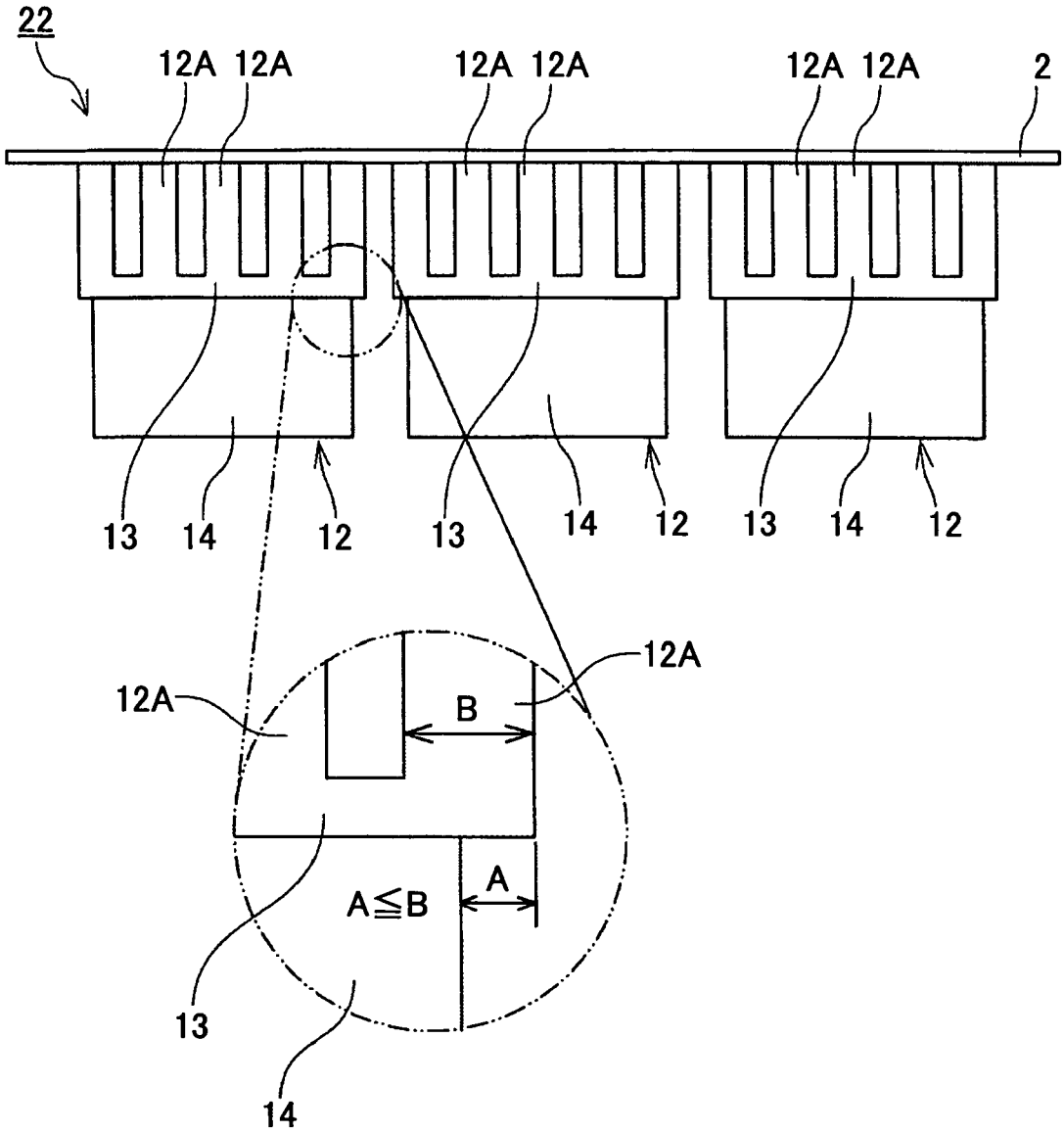
FIG. 10 is another schematic diagram for describing a piezoelectric element unit of a piezoelectric actuator according to an embodiment of the present invention.

Furthermore, as shown in FIG. 10, the protruding distance A of the piezoelectric element member 13 with respect to the base member 14 is controlled so that the protruding distance A is no greater than the width B of the piezoelectric element column 12A (A≦B). Accordingly, even in a case where the piezoelectric element columns 12A situated on both ends of the piezoelectric element member 13 are driven as piezoelectric elements 12*a*, loss of displacement amount of the piezoelectric elements 12*a* situated on both ends with respect to the vibration plate member 2 can be reduced since the piezoelectric elements 12*a* situated on both ends are securely held by the base member 14. Thereby, consistency of liquid jetting characteristics among the nozzles 5 can be attained.

Figure 11:
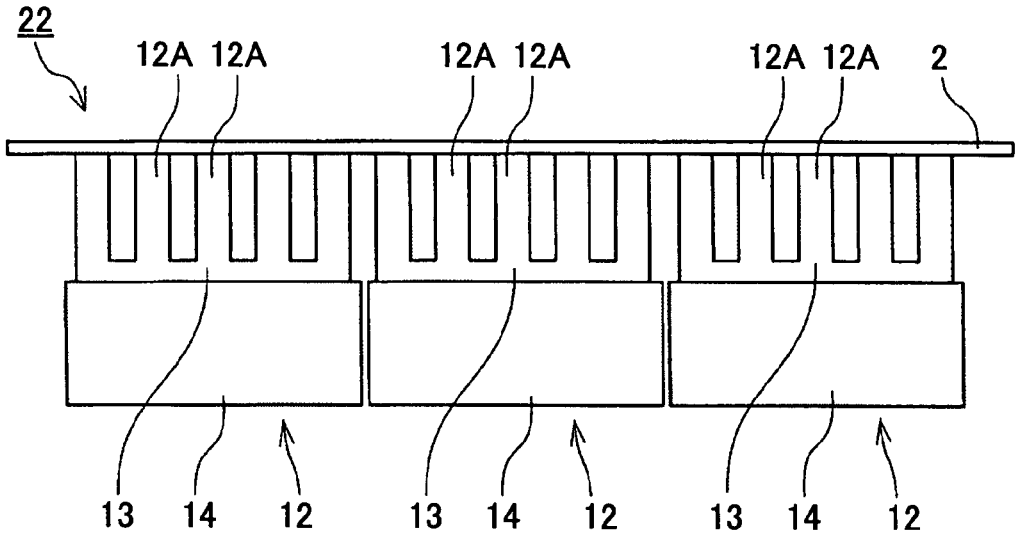
FIG. 11 is a schematic diagram for describing a piezoelectric actuator of a liquid jet head according to a fourth embodiment of the present invention.
Figure 12:
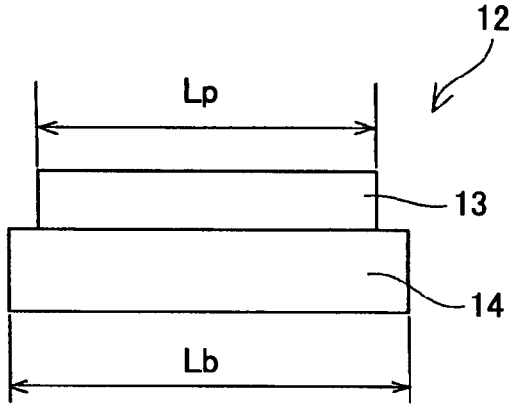
FIG. 12 is another schematic diagram for describing a piezoelectric element unit of a piezoelectric actuator according to an embodiment of the present invention.

Next, a liquid jet head H according to a fourth embodiment of the present invention is described with reference to FIGS. 11-12. FIG. 11 is a cross-sectional view with respect to a transverse direction of a liquid chamber of a piezoelectric actuator 22 of the liquid jet head H (direction that perpendicularly intersects the direction in which nozzles 5 are arranged). FIG. 12 is a schematic diagram for describing the piezoelectric actuator 22 shown in FIG. 11.

As shown in FIG. 12, each piezoelectric element unit 12 of the piezoelectric actuator 22 includes a piezoelectric element member 13 having a length Lp that is equal to or less than the length Lb of the base member 14 (Lb≧Lp). In this example, the piezoelectric element member 13 is formed with a length Lp less than the length Lb of the base member 14 (Lb>Lp) so that the base member 14 protrudes from both ends of the piezoelectric element member 13.

Accordingly, by having the base member 14 protrude from the piezoelectric element member 13, even in a case where the piezoelectric element columns 12A situated on both ends of the piezoelectric element member 13 are driven as piezoelectric elements 12*a*, the displacement amount of the piezoelectric elements 12*a* situated on both ends of the piezoelectric element member 13 can be substantially equal to that of the piezoelectric elements situated at the center area of the piezoelectric element member 13 since the entire area of the piezoelectric element member 13 in the longitudinal direction is securely fixed to the base member 14. Thereby, consistency of liquid jetting characteristics among the nozzles 5 can be attained.

Figure 13:
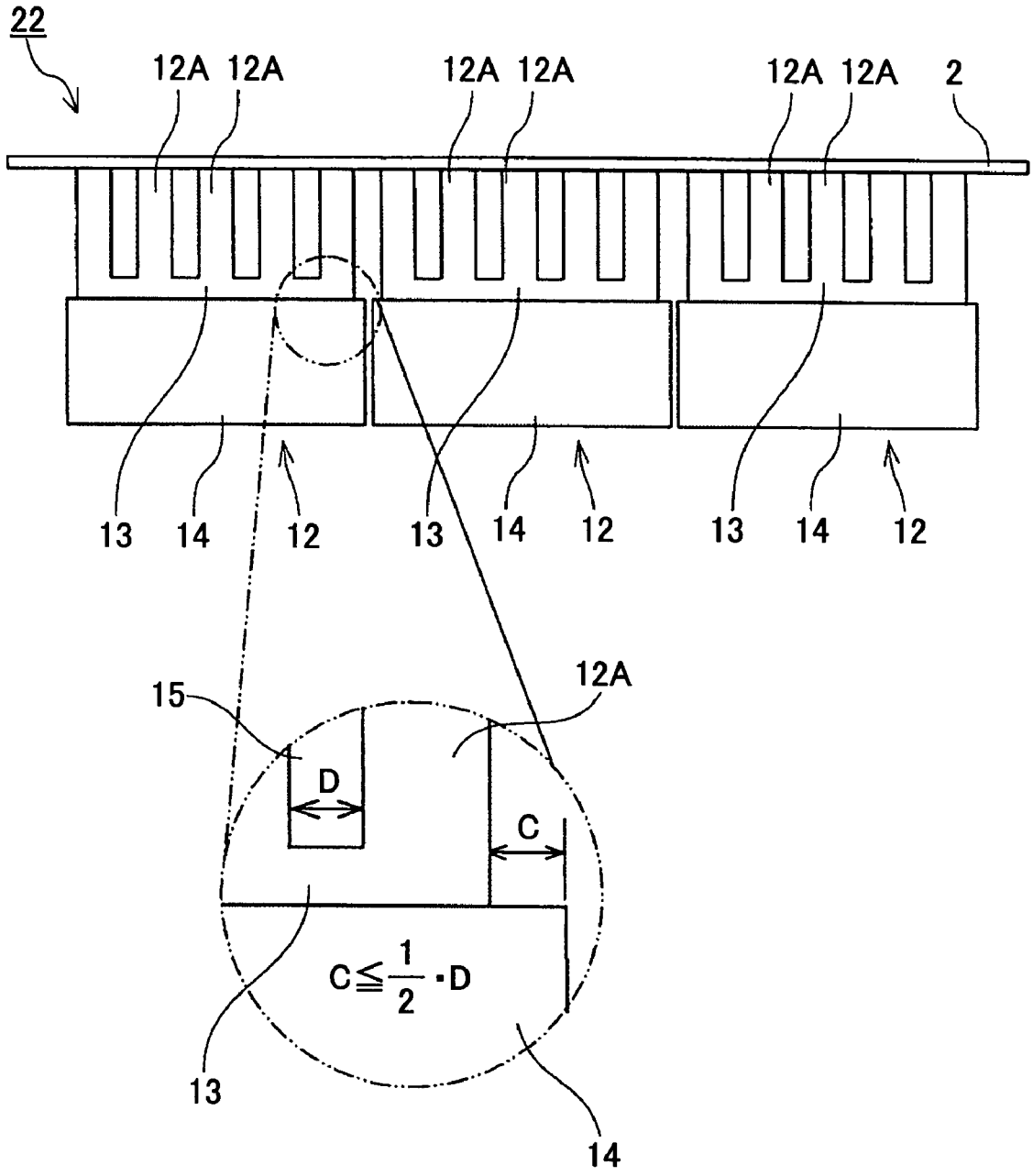
FIG. 13 is another schematic diagram for describing a piezoelectric element unit according to an embodiment of the present invention.

Furthermore, as shown in FIG. 13, the protruding distance C of the base member 14 with respect to the piezoelectric element member 13 is controlled so that the protruding distance C is no greater than half the width D of a slit 15 of the piezoelectric element member 13 (C≦(½)×D). Accordingly, since a gap between piezoelectric element members 13 of adjacent piezoelectric element units 12 is substantially equal to the width D of the slit 15, consistency of liquid jetting characteristics among the nozzles 5 can be attained.

Figure 14:
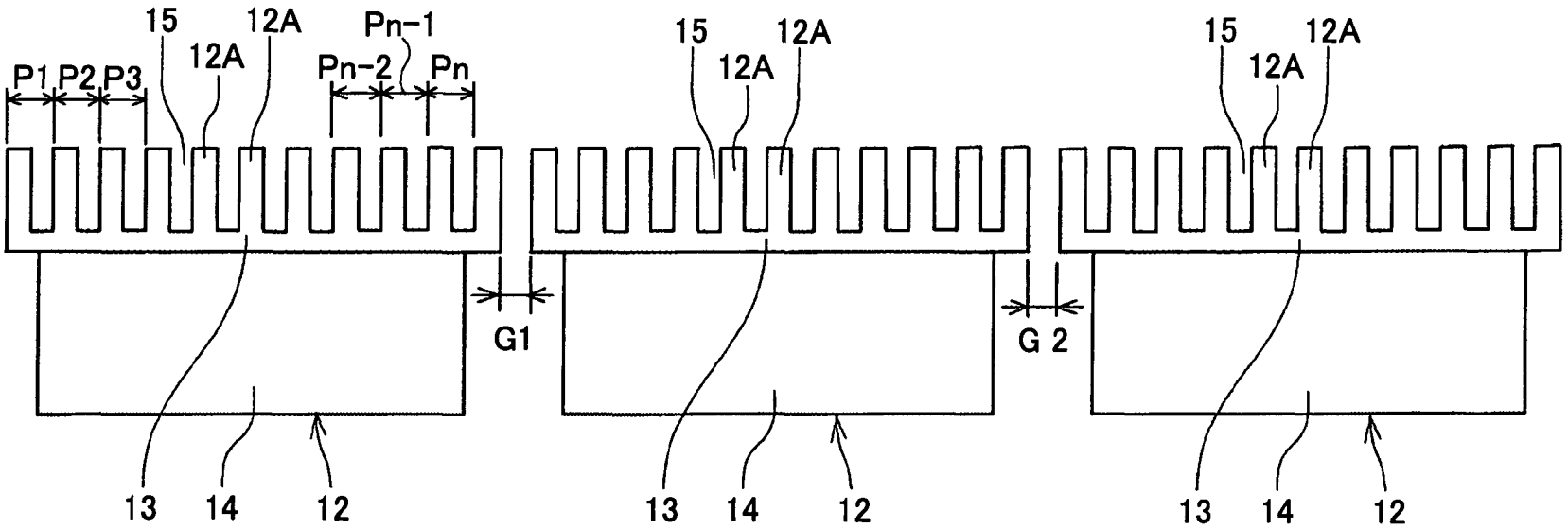
FIG. 14 is a schematic diagram for describing a relationship of the slit pitch and spaces of plural piezoelectric element units of a piezoelectric actuator of a liquid jet head according to an embodiment of the present invention.

Next, the pitch P of the slits 15 and gaps G of the piezoelectric element member 13 of adjacent piezoelectric element units 12 are described with reference to FIG. 14.

By controlling the varying of the gaps G (G1, G2, . . . ) between the piezoelectric element members 13 of adjacent piezoelectric element units 12 to a level no greater than 10%, the characteristics at the joining areas between piezoelectric can be substantially equal to the characteristics at areas other than the connecting areas. More specifically, it is preferable that the gaps G be controlled within ±15 μm.

Furthermore, by controlling the varying of the cumulative pitch ΣP=P (P1+P2+P3 . . . +Pn−2+Pn−1+Pn) of n pitches P of the slits 15 of the piezoelectric member 13 of each piezoelectric element unit 12 to a level no greater than 0.015%, a long length actuator and liquid jet head can be obtained without inconsistent pitches. More specifically, it is preferable that the varying of the cumulative pitch ΣP be controlled within ±5 μm.

Figure 15:
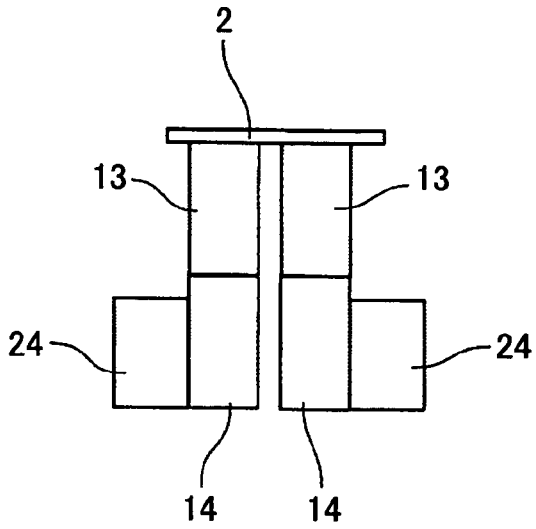
FIG. 15 is a schematic diagram (along a longitudinal direction of a liquid chamber) for describing a piezoelectric actuator of a liquid jet head according to a fifth embodiment of the present invention.
Figure 16:
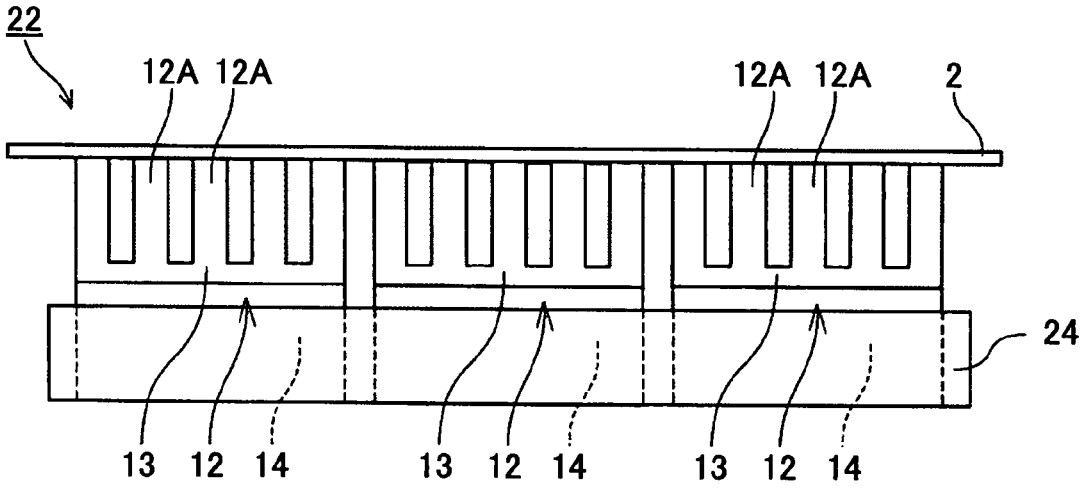
FIG. 16 is another schematic diagram (along a transverse direction of a liquid chamber) for describing a piezoelectric actuator of a liquid jet head according to the fifth embodiment of the present invention.

Next, a liquid jet head H according to a fifth embodiment of the present invention is described with reference to FIGS. 15-16. FIG. 15 is a cross-sectional view with respect to a longitudinal direction of a liquid chamber of a piezoelectric actuator 22 of the liquid jet head H (direction that perpendicularly intersects the direction in which nozzles 5 are arranged). FIG. 16 is a schematic diagram with respect to a transverse direction of the liquid chamber of the piezoelectric actuator 22 of the liquid jet head H.

In this example, a shared base member 24 is bonded to a side plane(s) of the base member 14 (the plane other than the plane to which the piezoelectric element member 13 is bonded). With this configuration, the height of the entire liquid jet head H can be controlled.

Figure 17:
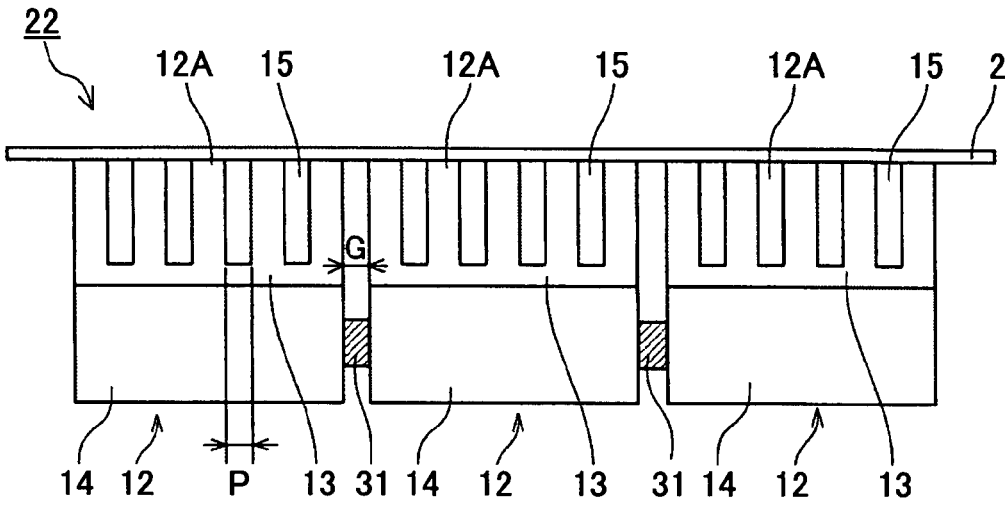
FIG. 17 is a schematic diagram for describing a process of manufacturing a piezoelectric actuator of a liquid jet head according to an embodiment of the present invention.

Next, a method of manufacturing a liquid jet head H according to a first embodiment of the present invention is described with reference to FIG. 17. It is to be noted that FIG. 17 is a schematic diagram for describing a part of a piezoelectric actuator according to an embodiment of the present invention. A space G is created between the piezoelectric element members 13 of adjacent piezoelectric element units 12 by placing a gap defining member 31 between the base members 14 of the adjacent piezoelectric element units 12 for applying an urging force against the base members 14 on both sides.

Thereby, the space G between the piezoelectric element members 13 of adjacent piezoelectric element units 12 can easily be formed with a desired measurement. This facilitates matching the position of piezoelectric elements and improves efficiency during assembly. It is to be noted that the gap defining member 31 may be bonded to the base member 14 to form a united body. The gap member 31 may also be removed after bonding the piezoelectric element units 12.

Figure 18:
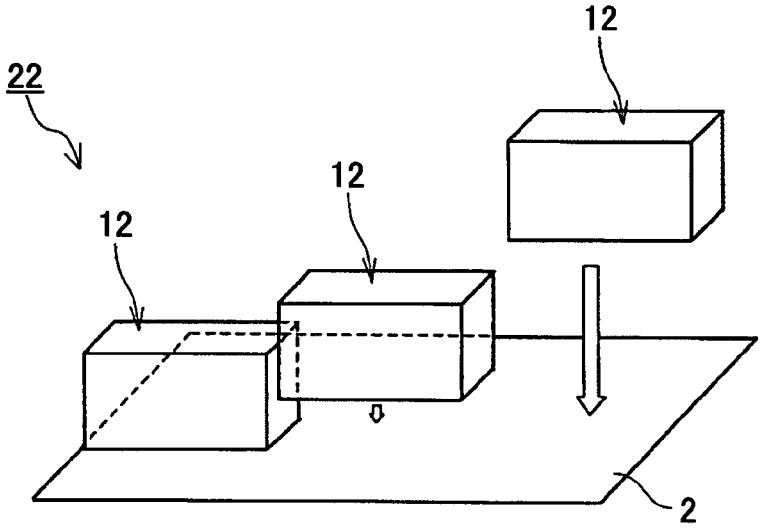
FIG. 18 is a schematic diagram for describing a process of manufacturing a piezoelectric actuator of a liquid jet head according to an embodiment of the present invention.

Next, a method of manufacturing a liquid jet head H according to an embodiment of the present invention is described with reference to FIG. 18. It is to be noted that FIG. 18 is a schematic diagram for describing a part of a piezoelectric actuator according to an embodiment of the present invention.

In this embodiment of the present invention, plural piezoelectric element units 12 are bonded to a vibration plate member (fixing member) 2 and arranged in a line. With this method, there is no need to manage the height of the piezoelectric element unit 12 or the flatness of the piezoelectric element unit 12. This improves assembly property and yield.

Next, a method of manufacturing a liquid jet head according to an embodiment of the present invention is described with reference to FIG. 19. It is to be noted that FIG. 19 is a schematic diagram for describing a part of a piezoelectric actuator according to an embodiment of the present invention.

Figure 19:
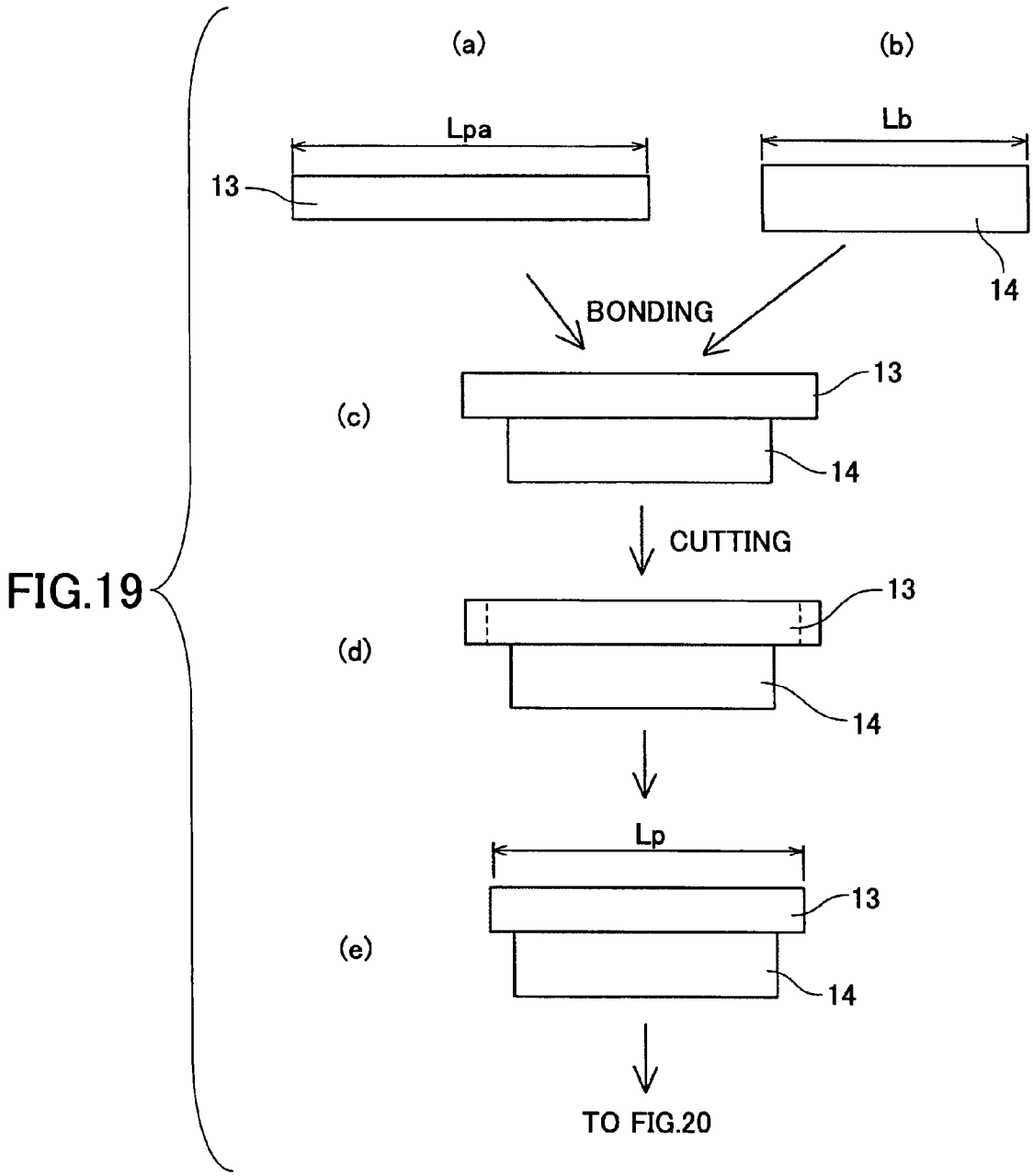
FIG. 19 is a schematic diagram for describing a process of manufacturing a piezoelectric actuator of a liquid jet head according to an embodiment of the present invention.

First, a piezoelectric element member 13 having a length of Lpa (see (a) of FIG. 19) and a base member 14 having a length of Lb (Lb<Lp) (see (b) of FIG. 19) are prepared. Then, the piezoelectric element member 13 is mounted on the base member 14 and bonded to the base member 14 with an adhesive agent (see (c) of FIG. 19). As shown in (c) of FIG. 19, the piezoelectric element member 13 is mounted on the base member 14 in a manner where both end parts of the piezoelectric element member 13 protrude from the base member 13 (First Step).

Then, as shown in (d) and (e) of FIG. 19, the piezoelectric element member 13 is cut to a length of Lp by cutting predetermined areas (illustrated with dotted lines) at both end parts of the piezoelectric element member 13 (Intermediate Step).

Figure 20:
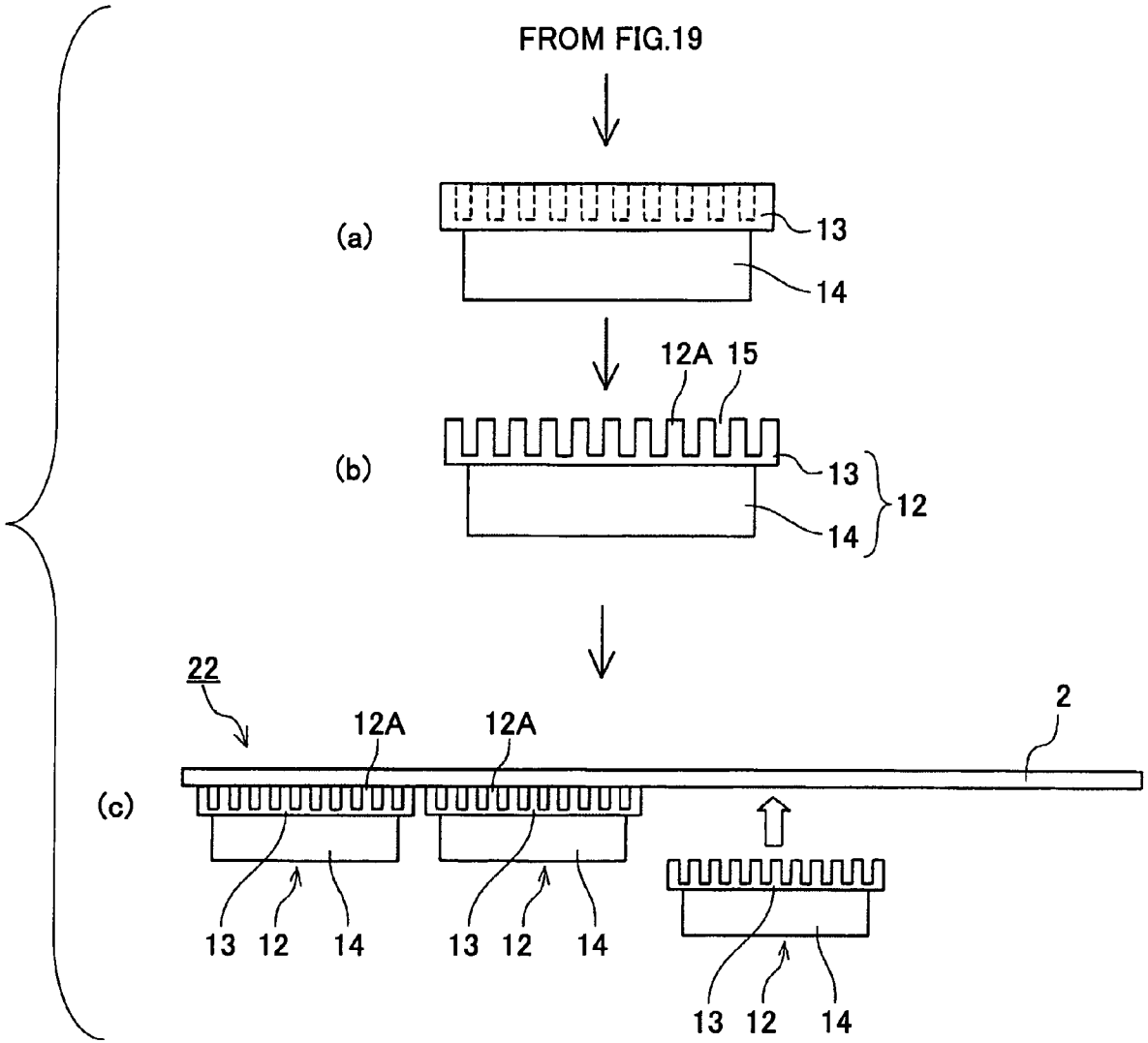
FIG. 20 is a schematic diagram for describing a process continuing from the process of manufacturing a piezoelectric actuator of a liquid jet head shown in FIG. 19.

Then, as shown in (a) of FIG. 20, a slitting process is performed on the piezoelectric element member 13 at predetermined areas (illustrated with dotted lines) of the piezoelectric element member 13 by using a slitting process machine (e.g., dicing blade). Thereby, as shown in (b) of FIG. 20, plural slits 15 are formed at a predetermined pitch in the piezoelectric element member 13. As a result, a piezoelectric element unit 12 having plural divided piezoelectric elements 12A can be fabricated (Second Step).

Then, as shown in (c) of FIG. 20, the fabricated piezoelectric element units 12 are sequentially bonded at predetermined intervals to the vibration plate member (fixing member) 2.

As a more specific example, first, a base member 14 having a length Lb of approximately 30 mm and a piezoelectric element member 13 having a length Lpa several ten to several hundred μm longer than the length Lb of the base member 14 are prepared. Then, the piezoelectric element member 13 is mounted on the base member 14 and bonded to the base member 14 with an adhesive agent (First Step). Then, the piezoelectric element member 13 is cut to a length Lp by cutting off several ten μm from both end parts of the piezoelectric element member 13 (Intermediate Step). Then, the slitting process is performed on the piezoelectric element member 13 in which the slits 15 are formed with a width of approximately 30 μm, a depth of approximately 600 μm, and a pitch of approximately 100 μm (Second Step). Then, the piezoelectric element units 12 are fixed to the vibration plate member (fixing member) 2 in which the interval (space) between adjacent piezoelectric element units 12 is equal to the width D of the slit 15 formed in the piezoelectric element member 13 (Third Step).

Accordingly, a long length piezoelectric actuator or a liquid jet head can easily be obtained by using the above-described configuration having plural piezoelectric element units fixed to the vibration plate member (fixing member) in a straight line along the arrangement of nozzles, in which each piezoelectric element unit includes a base member fixed to a piezoelectric element member having plural piezoelectric elements divided by plural slits.

Next, the cutting of the piezoelectric element member in the above-described Intermediate Step is described in further detail with reference to FIGS. 21-24.

Figure 21:
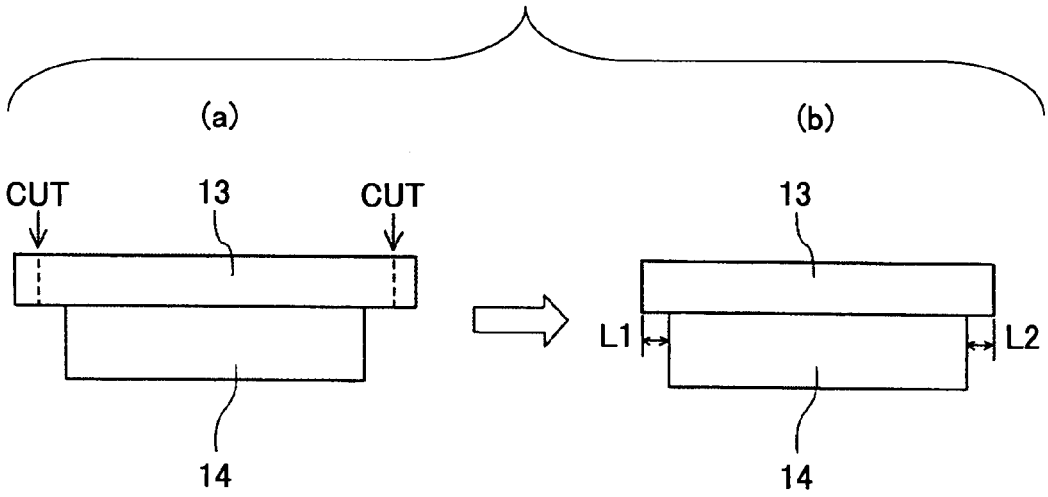
FIG. 21 is a schematic diagram for describing an Intermediate Step and a relationship of a base member with respect to a piezoelectric element member according to an embodiment of the present invention.

First, in the Intermediate Step, both end parts of the piezoelectric element member 13 bonded to the base member 14 are cut as shown in (a) of FIG. 21. As a result, both end parts of the piezoelectric element member 13 protrude a predetermined amount L1, L2 with respect to the ends of the base member 14 as shown in (b) of FIG. 21. It is preferable that the protruding distance L1 is substantially equal to the protruding distance L2 (L1=L2). In a case where the Intermediate Step is not conducted, the piezoelectric element member 13 may be bonded to the base member 14 in a position allowing the protruding distance L1 to be substantially equal to the protruding distance L2.

Thereby, in a case where the piezoelectric elements 12*a* to be driven are the piezoelectric element columns 12A situated at both end parts of the piezoelectric element member 13, the varying amount of disposition of the piezoelectric elements 12*a* can be reduced. For example, in a case where the protruding distance for both L1 and L2 are set to approximately 20 μm or less, the disposition amount of the piezoelectric elements 12*a* situated at both end parts are substantially equal to the piezoelectric elements 12*a* situated at the center part (part other than the end parts) of the piezoelectric element member 13.

Figure 22:
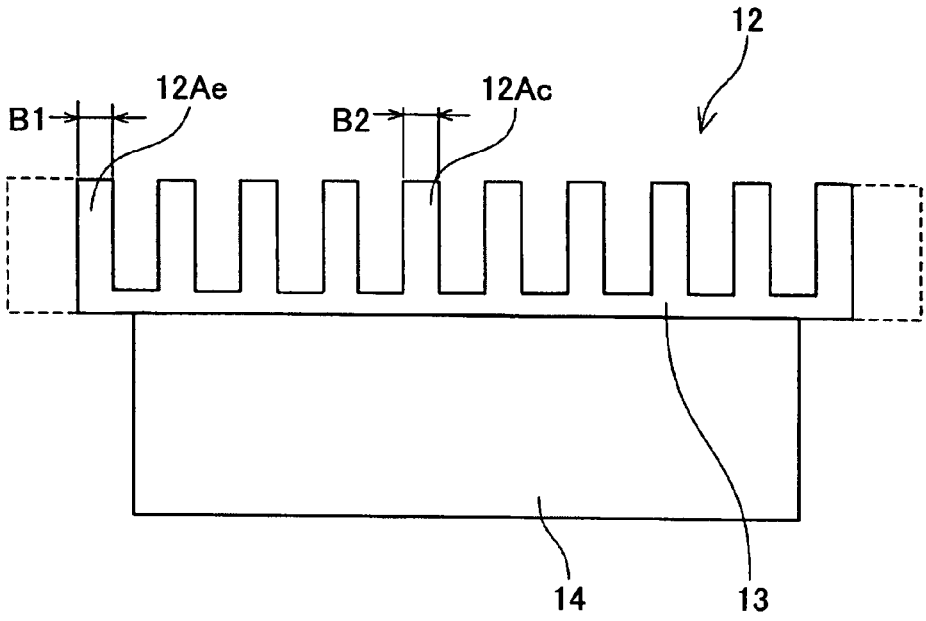
FIG. 22 is a schematic diagram for describing an Intermediate Step and the width of a piezoelectric element column of a piezoelectric element member according to an embodiment of the present invention.

Furthermore, in the Intermediate Step as shown in FIG. 22, it is preferable to cut both end parts of the piezoelectric element member 13 so that the width B1 of the piezoelectric element column 12Ae situated at each end part is substantially equal to the width B2 of a piezoelectric element column 12Ac situated at the center part. In order for the width B1 of the piezoelectric element column 12Ae situated at each end part to be substantially equal to the width B2 of a piezoelectric element column 12Ac situated at the center part in a case where the Intermediate Step is not conducted, the length Lp of the piezoelectric element member 13 which is defined by the number of slits and the width of the slits may be processed so that it matches the length defined by the number of piezoelectric element columns and the width of the piezoelectric element columns, and perform a slitting process after bonding the piezoelectric element member 13 to the base member 14.

Accordingly, the electrostatic amount of the piezoelectric element columns 12Ae situated at both end parts of the piezoelectric element member 13 becomes substantially equal to the electrostatic amount of the piezoelectric element columns 12Ac situated at the center part of the piezoelectric element member 13. Thus, inconsistency between the characteristics of the piezoelectric element columns 12Ae situated at both end parts of the piezoelectric element member 13 and the characteristics of the piezoelectric element columns 12Ac situated at the center part of the piezoelectric element member 13 can be reduced.

Figure 23:
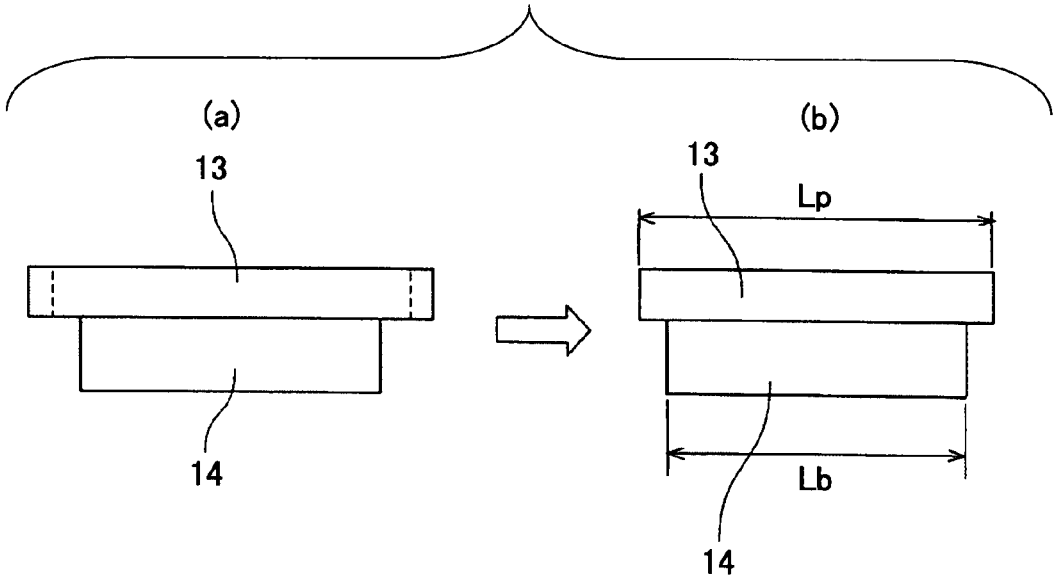
FIG. 23 is a schematic diagram for describing an Intermediate Step and a relationship between the length of a piezoelectric element member and the length of a base member according to an embodiment of the present invention.

From another aspect the piezoelectric element member 13 is cut so that the length Lp of the piezoelectric element member 13 is no less than the length Lb of the base member 14 as shown in (a) and (b) of FIG. 23.

Accordingly, since both end parts of the piezoelectric element member 13 protrude from the base member 14, plural piezoelectric element units 12 can be arranged at predetermined intervals (spaces) G. This prevents base members 14 from abutting each other due to, for example, dimension error, to thereby ensure a desired space G between the piezoelectric element units 12. Thus, the arranging and bonding of the piezoelectric element units 12 can be facilitated.

Figure 24:
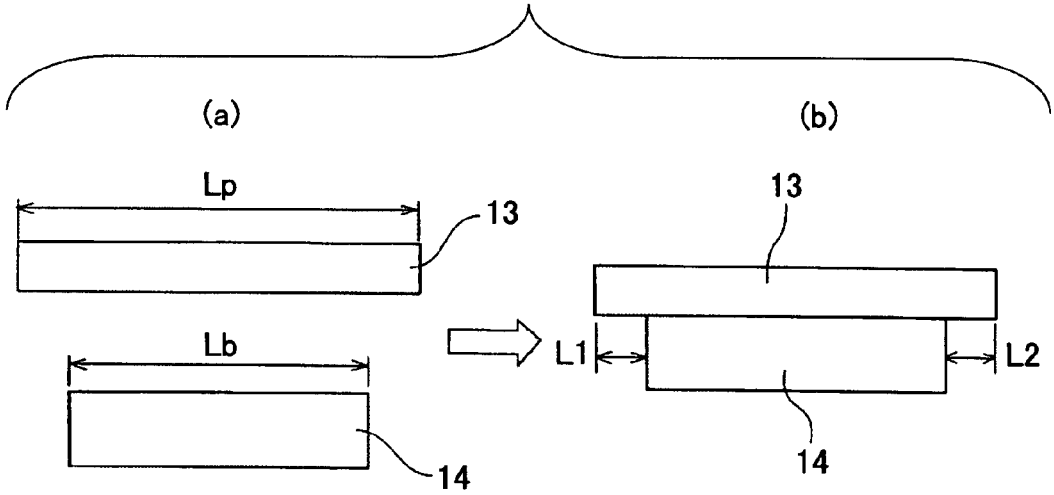
FIG. 24 is a schematic diagram for describing an Intermediate Step and a relationship between the length of a piezoelectric element member and the length of a base member in a First Step according to an embodiment of the present invention.

From another aspect, the piezoelectric element member 13, which is used for bonding to the base member 14 in the First Step, can be prepared with a length Lp longer than the length Lb of the base member 14 as shown in (a) and (b) of FIG. 24. This facilitates the processes in the Intermediate Step.

Figure 25:
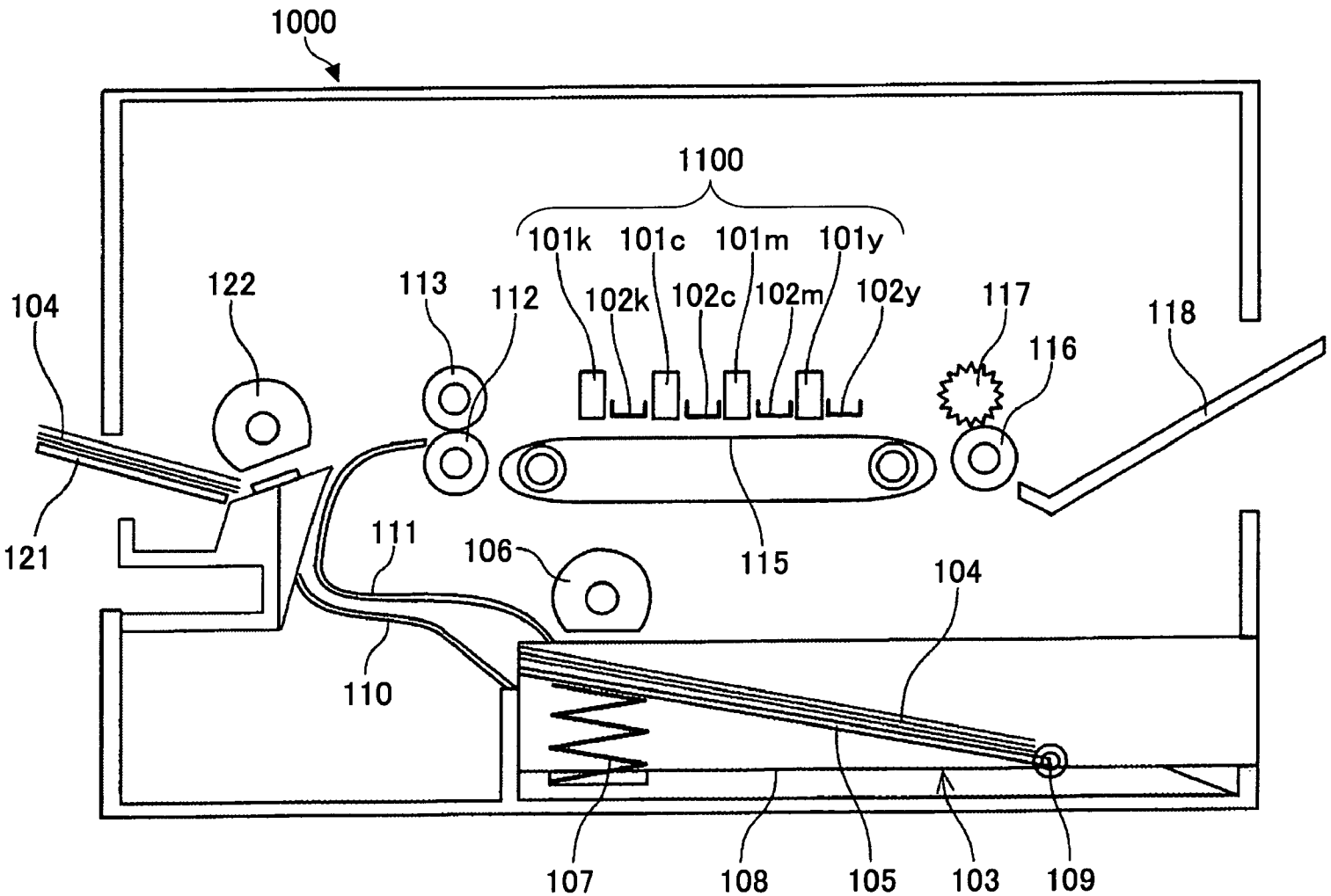
FIG. 25 is a schematic diagram showing an exemplary configuration of an image forming apparatus including a liquid jetting apparatus according to an embodiment of the present invention.

Next, an example of an image forming apparatus 1000 having a liquid jetting apparatus 1100 including a liquid jet head H according to an embodiment of the present invention is described with reference to FIG. 25. FIG. 25 is a schematic diagram for describing an overall configuration of a mechanism part of the image forming apparatus 1000.

In this example, the image forming apparatus 1000 is a line type image forming apparatus having a full line type recording head including a nozzle array (arrangement of nozzles 5) in which the length of the nozzle array is no less than the width of the printable area of the medium.

In this example, the image forming apparatus 1000 includes a liquid jetting apparatus 1100 having four full line type liquid jet heads (recording heads) 101*k*, 101*c*, 101*m*, and 110*y* (also referred to as "recording head 101" when not particularly differentiating the colors) for jetting liquid droplets of, for example, black (K), cyan (C), magenta (M), and yellow (Y). The recording head 101 is mounted to a head holder (not shown) in a manner having its nozzle surface (surface at which nozzles 5 are formed) facing downwards. The image forming apparatus 1000 also includes a maintenance/recovery mechanism 102 corresponding to each recording head 101 for maintaining and recovering the performance of the corresponding recording head 101. In performing a performance recovery process (e.g., purging process, wiping process), the recording head 101 and the maintenance/recovery mechanism 102 are moved with respect to each other (relative movement) so that, for example, the nozzle surface of the recording head 101 faces a capping part of the maintenance/recovery mechanism 102.

Although the recording heads 101*k*, 101*c*, 101*m*, and 101*y* in this example are arranged in an order of black, cyan, magenta, and yellow from the upstream side of the sheet conveying direction, the arrangement or the number of colors are not to be limited. Furthermore, the image forming apparatus 1000 may have one or more heads in which each head includes plural nozzle arrays arranged at predetermined intervals for jetting liquid droplets of respective colors. Furthermore, a recording liquid cartridge for supplying recording liquid to the head may be formed separately or as a united body with the head.

The image forming apparatus 1000 also has a sheet-feed tray 103 having a base plate 105 on which sheets 104 are stacked and a sheet-feed roller (half-moon shaped roller) 106 for feeding the sheets 104. The base plate 105 is concentrically rotatable about a rotation axle 109 attached to a base 108 and is urged towards the sheet-feed roller 106 by a pressure spring 110. Furthermore, a separating pad (not shown) formed of a material having large friction coefficient (e.g., synthetic leather, cork material) is provided in a manner facing the sheet-feed roller 106 for preventing sheets 104 from being fed in an overlapped manner. Furthermore, a release cam (not shown) is provided for releasing the contact between the bottom plate 105 and the sheet-feed roller 106.

The image forming apparatus 1000 also has guide members 110, 111 for guiding a sheet 104 from the sheet-feed tray to the part between a conveying roller 112 and a pinch roller 113.

The conveying roller 112 being rotated by a driving source (not shown) conveys the sheet to a platen member 115 positioned in a manner facing the recording head 101. As long as a predetermined distance between the recording head 101 and the sheet 104 can be maintained, the platen member 115 may be configured having a rigid body or configured as a conveyor belt.

A discharge roller 116 and a spur member 117 facing the discharge roller 116 are provided at a downstream side of the platen member 115 for discharging the sheet 104 (on which an image is formed) to a discharge tray 118.

On the opposite side of the discharge tray 118, the image forming apparatus 1000 has a manual feed tray 121 on which a sheet 104 manual sheet feeding is placed and a sheet-feed roller 122 for feeding the sheet 104 placed on the manual feed tray 121. The sheet 104 fed by the sheet-feed roller 122 is guided to the part between the conveying roller 112 and the pinch roller 113 by the guide member 111.

In a case where the image forming apparatus 1000 is in a standby state, a release cam (not shown) lowers the base plate 105 of the sheet-feed tray 103 to a predetermined position so that the contact between the base plate 105 and the sheet feed roller 106 is released. Then, in activating the image forming apparatus 1000 from this state, a gear member (not shown) transmits a rotary driving force to the sheet-feed roller 106 and the release cam (not shown). Thereby, the release cam (not shown) separates from the base plate 105, to thereby raise the base plate 105 to a position contacting the sheet-feed roller 106 and the sheet 104. Then, as the rotation of the sheet-feed roller 106 is started, a sheet 104 is picked up and separated from the other sheets by a separating claw (not shown) so that the sheets 104 can be fed sheet by sheet.

Then, by rotating the sheet-feed roller 106, the sheet 104 is guided to a gap between the conveying roller 112 and the pinch roller 113 by guide members 110, 111. Then, the conveying roller 112 delivers the sheet 104 on top of the platen 115. Then, the rear end of the sheet 104 situated opposite of the sheet-feed roller 106 (cut into a D-shape) is released by the conveying roller 112 and conveyed on the platen 115. It is to be noted that a pair of sheet conveying rotating parts may be provided between the sheet-feed roller 106 and the conveying roller 112.

Then, an image is formed on the sheet 104 conveyed on the platen 115 by jetting liquid droplets onto the sheet 104 from the recording head 1. Then, the sheet 104 is discharged to the sheet discharge tray 118 by the sheet discharge roller 116. It is to be noted that the speed of the conveying the sheet during the image forming process and the timing for jetting the liquid droplets during the image forming process are controlled by a control part (not shown).

With the above-described line type liquid jet head according to an embodiment of the present invention, high quality images can be formed at high speed.

Figure 26:
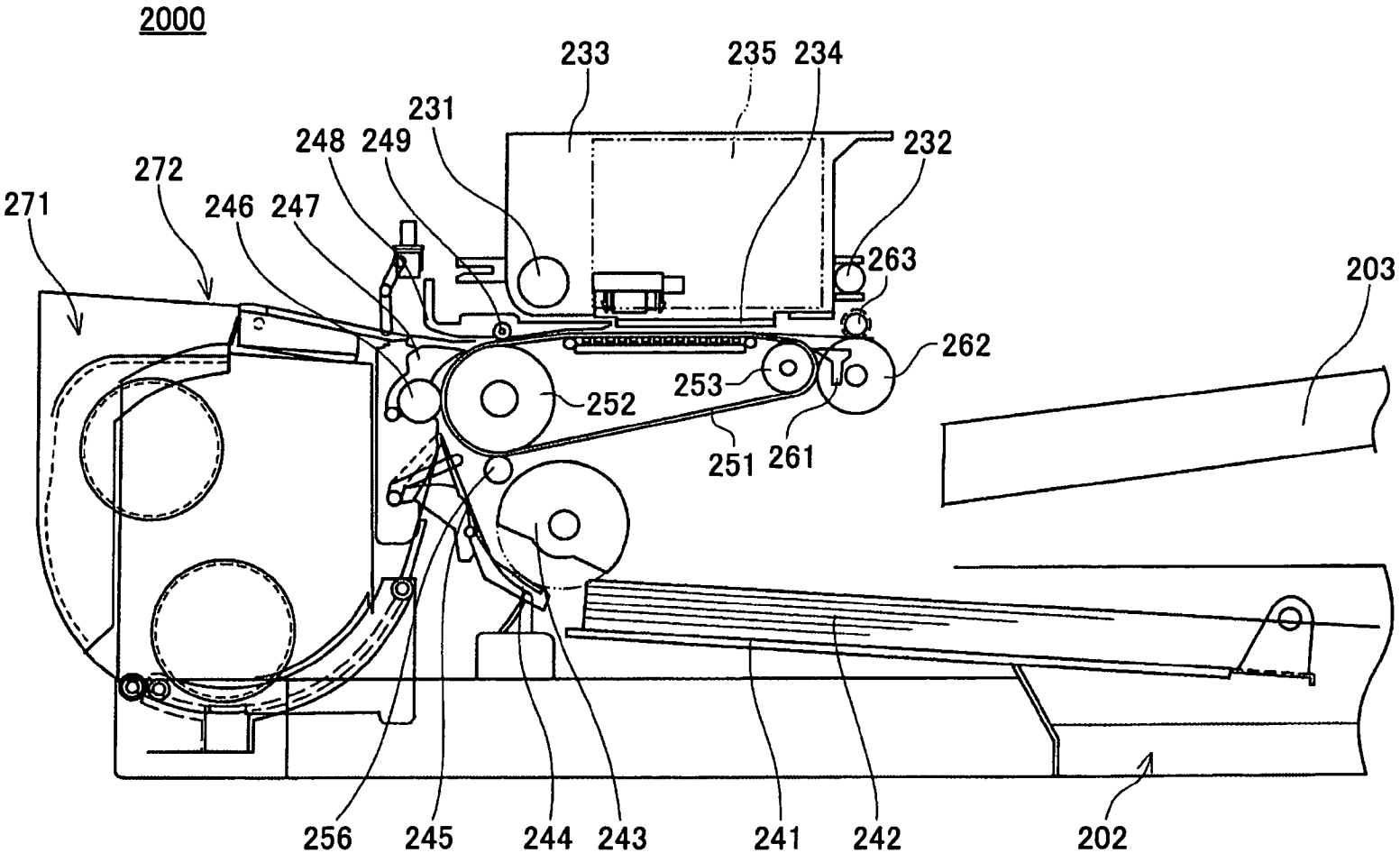
FIG. 26 is a schematic diagram showing an exemplary configuration of an image forming apparatus including a liquid jetting apparatus according to another embodiment of the present invention.
Figure 27:
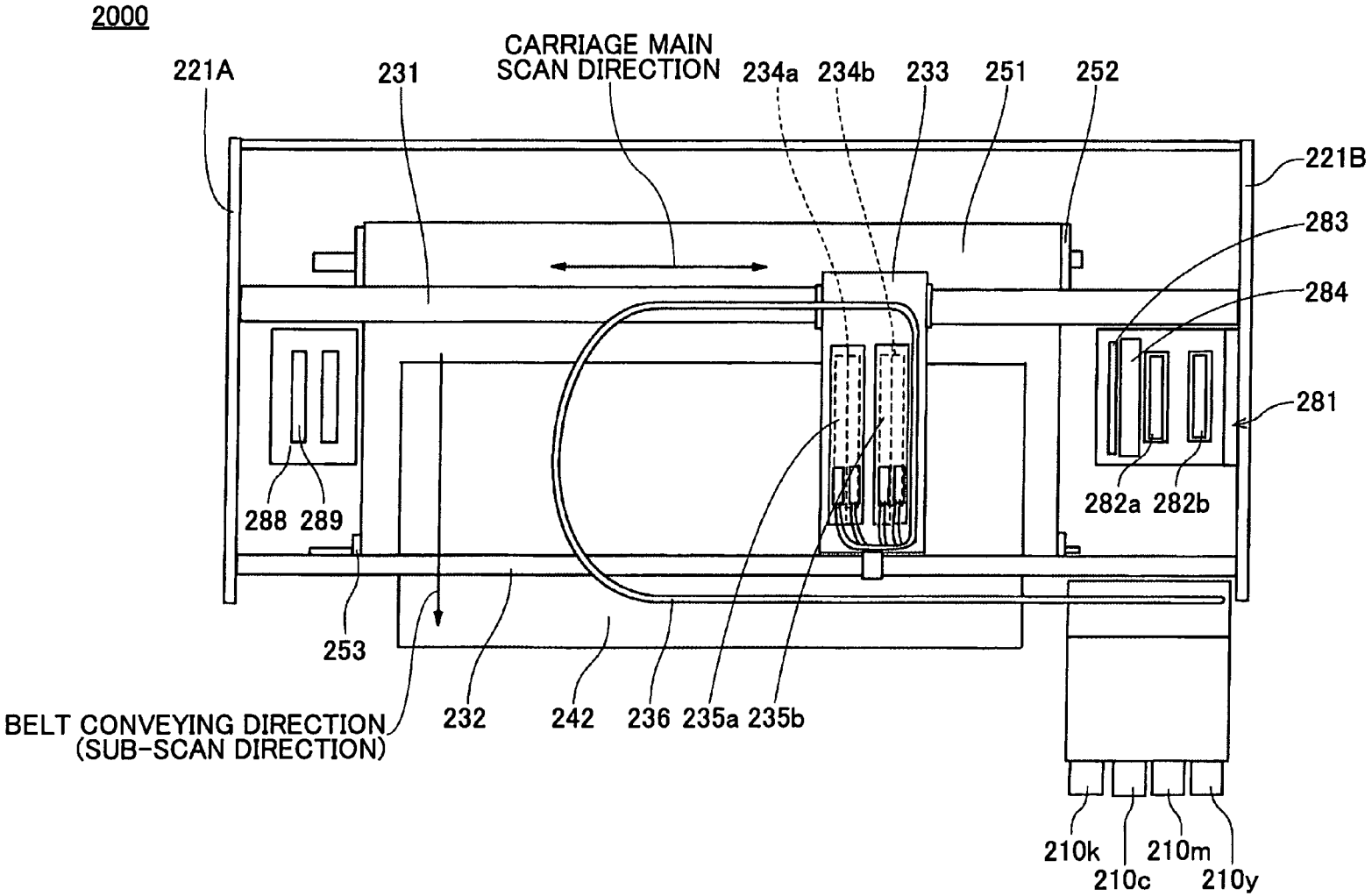
FIG. 27 is a plan view showing the exemplary configuration of the image forming apparatus shown in FIG. 26.

Next, an example of an image forming apparatus 2000 having a liquid jetting apparatus including a liquid jet head according to another embodiment of the present invention is described with reference to FIGS. 26 and 27. FIG. 26 is a schematic diagram for describing an overall configuration of a mechanism part of the image forming apparatus 2000. FIG. 27 is a plan view for describing a portion of the mechanism part of the image forming apparatus 2000.

The image forming apparatus 2000 is a serial type image forming apparatus including a main guide rod 231 and a sub guide rod 232 (guiding members) attached to left and right side planes 201A and 201B in a traverse manner. The main guide rod 231 and the sub guide rod 232 hold a carriage 233 in a manner enabling the carriage 233 to slide in a main scanning direction. Accordingly, the carriage 233 is moved in a carriage main scan direction (arrow direction in FIG. 27) by a main scan motor (not shown) via a timing belt.

The carriage 233 has two recording heads 234*a* and 234*b* (also referred to as "recording head 234" when not particularly differentiating the colors) including plural liquid jet heads according to an embodiment of the present invention for jetting ink droplets of yellow (Y), cyan (C), magenta (M), and black (K). The recording head 234 includes one or more nozzle arrays having plural nozzles arranged in a sub-scanning direction that perpendicularly intersect with a main scanning direction. The recording head 234 is mounted facing downward in the ink droplet jetting direction.

Each recording head (234*a*, 234*b*) includes two nozzle arrays. The recording head 234*a* has one array for jetting liquid droplets of black (B) and another array for jetting liquid droplets of cyan (C). The recording head 234*b* has one array for jetting liquid droplets of magenta (M) and another array for jetting liquid droplets of yellow (Y).

The carriage 233 also includes head tanks 235*a*, 235*b* (also referred to as "head tank 235" when not particularly differentiating the colors) for supplying ink of each color corresponding to the nozzle arrays of the recording head 234. Ink of each color are supplied from corresponding ink cartridges 210 (210*y*, 210*c*, 210*m*, and 210*k*) to the head tank 235 via a supply tube 36 corresponding to each color.

The image forming apparatus 2000 also includes a sheet-feed part for feeding sheets 242 stacked on a sheet stacking part 241 (platen) of a sheet-feed tray 202. The sheet-feed part includes a half-moon shaped sheet-feed roller 243 for feeding the sheets 242 sheet by sheet, and a separating pad 244 situated on the opposite side of the sheet-feed roller 243 for separating a sheet from the sheets 242 stacked on the sheet stacking part 241. The separating pad 244, which is formed of a material having high friction coefficient, is urged in a direction towards the sheet-feed roller 243.

In order to feed a sheet 242 from the sheet-feed part to an area below the recording head 234, the image forming apparatus 2000 includes a guide member 245 for guiding the sheet 242, a counter roller 246, a conveyor guide member 247, and a pressing member 248 having a tip pressing roller 249. Furthermore, the image forming apparatus 2000 also includes a conveyor belt 251 (conveying part) for electrostatically attracting the sheet 242 thereto and conveying the sheet 242 through an area facing the recording head 234.

In this example, the conveyor belt 251 is an endless belt stretched across between a conveyor roller 252 and a tension roller 253. The conveyor belt 251 is rotated in a belt conveying direction (sub-scan direction). Furthermore, the image forming apparatus 2000 includes a charge roller 256 (charging part) for charging the surface of the conveyor belt 251. The charge roller 256 contacts the surface layer of the conveyor belt 251. The charge roller 256 is positioned to rotate in correspondence with the rotation of the conveyor belt 251. The conveyor belt 251 is rotated in the belt conveying direction by rotating (driving) the conveyor roller 252 at a predetermined timing by using a sub-scan motor (not shown).

Furthermore, the image forming apparatus 2000 includes a discharge part for discharging the sheet 242 having an image recorded thereto by the recording head 234. The discharge part includes a separating claw part 261 for separating the sheet 242 from the conveyor belt 251, a sheet discharge roller, and another sheet discharge roller 263. The discharge part also includes a sheet discharge tray 203 provided below the sheet discharge roller 262.

Furthermore, a double-side unit 271 is detachably attached to a rear part of a main body 1 of the image forming apparatus 2000. The double-side unit 271 obtains the sheet 242 being fed by reversely rotating the conveyor belt 251. Then, the double-side unit 271 flips over the sheet 242. Then, the double-side unit 271 returns the flipped sheet 242 to the gap between the counter roller 246 and the conveyor belt 251. Furthermore, the upper surface of the double-side unit 271 is used as a manual sheet-feed tray 272.

Furthermore, a maintenance/recovery mechanism (head maintenance/recovery apparatus) 281 including a part for maintaining the nozzles of the recording head 234 in an operable state and recovering the nozzles of the recording head 234 is provided in a target printing area on one side of a main scanning direction of the carriage 233.

The maintenance/recovery mechanism 281 includes caps (cap members) 282*a*, 282*b* (also referred to as "cap 282" when not particularly differentiating the colors) for covering the surface of each nozzle in the recording head 234, a wiper blade (blade member) 283 for wiping the nozzle surface, and a blank jet receptacle 284 for receiving liquid droplets when blank jetting is conducted for jetting unwanted residual recording liquid.

An ink collecting unit (blank jet receptacle, liquid collecting container) 288 is provided in a target printing area on the other side of the main scanning direction of the carriage 233 for receiving liquid droplets when blank jetting is conducted for jetting unwanted residual recording liquid. The ink collecting unit 288 includes, for example, opening parts provided along the nozzle array direction of the recording head 234.

With the image forming apparatus 2000 having the above-described configuration, sheets 242 stacked on the sheet-feed tray 202 are fed sheet by sheet. Then, a sheet 242 being fed substantially perpendicularly upward is guided to a gap between the conveyor belt 251 and the counter roller 246 by the guide members 245. Then, the sheet 242 is further conveyed and guided by the conveyor guide member 247. Then, the sheet 242 is pressed against the conveyor belt 251 by the tip pressing roller 249 so that the conveying direction of the sheet 242 is changed approximately 90 degrees.

The alternating voltages of positive outputs and negative outputs are applied to the charge roller 256. Thereby, the conveyor belt 251 is applied with alternate charges according to a predetermined charging pattern. That is, the conveyor belt 251 is alternately applied with positive and negative charges at predetermined intervals in the belt-rotating direction (sub-scan direction). By placing the sheet 242 to the charged conveyor belt 251, the sheet 242 is attracted to the conveyor belt 251 and is conveyed by the conveyor belt 251 in a sub-scan direction according to the rotation of the conveyor belt 251.

Then, along with the movement of the carriage 233, the recording head 234 is driven according to image signals, to thereby record a singe line of data onto the sheet 242 stopped at a predetermined position on the conveyor belt 251 by jetting ink droplets onto the sheet 242. Then, after moving the sheet 242 for a predetermined amount, the next line of data is recorded onto the sheet 242. Upon receiving a recording completion signal or a signal indicating that the rear end of the sheet 242 has reached a predetermined recording area, the recording process is finished. Then, the sheet 242 is discharged to the sheet discharge tray 203.

With the above-described serial type liquid jet head according to an embodiment of the present invention, high quality images can be formed at high speed by using a long length liquid jet head according to an embodiment of the present invention.

It is to be noted that, although the liquid jet apparatus according to an embodiment of the present invention is described as an image forming apparatus having a printer configuration, the liquid jet apparatus is not limited to such configuration. For example, the liquid jet apparatus may be an image forming apparatus having a configuration of a multi-function machine (printer/facsimile/copier). Furthermore, the present invention may be applied to an image forming apparatus using liquids other than ink (e.g., fixing solutions, other recording liquids). Furthermore, although the above-described plural piezoelectric element units according to an embodiment of the present invention is described as sharing the same nozzle plate, a flow path, and a vibration plate member, each piezoelectric element unit may be formed as a united body with a corresponding flow path and a vibration plate member so that only the nozzle plate is shared among plural piezoelectric element units.

Further, the present invention is not limited to these embodiments, but variations and modifications may be made without departing from the scope of the present invention.

The present application is based on Japanese Priority Application Nos. 2006-146140 and 2007-038618 filed on May 26, 2006 and Feb. 19, 2007, with the Japanese Patent Office, the entire contents of which are hereby incorporated by reference.

What is claimed is:

1. A liquid jet head comprising:

a nozzle plate having a plurality of nozzles for jetting liquid therefrom;

a plurality of flowpaths formed in communication with the plural nozzles;

a vibration plate member having a flexible part that forms at least one of the walls of each flowpath; and a plurality of piezoelectric element units having respective plural piezoelectric element members fixed to respective plural base members, each piezoelectric element unit having a plurality of piezoelectric elements divided by a plurality of slits formed in the piezoelectric element member;

wherein the plural piezoelectric element units are arranged in a straight line at predetermined intervals along the plural nozzles.

2. The liquid jet head as claimed in claim 1, wherein the width of each slit is substantially equal to the interval between the piezoelectric element members of adjacent piezoelectric element units, wherein the pitch between the slits is substantially equal to the pitch between the slit and the interval.

3. The liquid jet head as claimed in claim 1, wherein the plural piezoelectric elements of the piezoelectric units are fixed to a single vibration plate member.

4. The liquid jet head as claimed in claim 1, wherein the base members of the plural piezoelectric element units are fixed to a single shared base member.

5. The liquid jet head as claimed in claim 4, wherein the shared base member is bonded to a plane of the base member other than the plane for bonding to the piezoelectric element member.

6. The liquid jet head as claimed in claim 1, wherein the plural nozzles are arranged in plural lines, wherein the plural piezoelectric element units are arranged in plural lines.

7. The liquid jet head as claimed in claim 1, wherein the piezoelectric element member protrudes from an end of the base member in the direction in which the nozzles are arranged.

8. The liquid jet head as claimed in claim 7, wherein the distance of the piezoelectric element member protruding from the base member is no greater than the width of the piezoelectric element.

9. The liquid jet head as claimed in claim 7, wherein the distance of the piezoelectric element member protruding from one end of the base member is substantially equal to the distance of the piezoelectric element member protruding from the other end of the base member.

10. The liquid jet head as claimed in claim 1, wherein the base member protrudes from an end of the piezoelectric element member in the direction in which the nozzles are arranged.

11. The liquid jet head as claimed in claim 10, wherein the distance of the base member protruding from the piezoelectric element member is no greater than half the width of the slit.

12. The liquid jet head as claimed in claim 10, wherein the distance of the base member protruding from one end of the piezoelectric element member is substantially equal to the distance of the base member protruding from the other end of the piezoelectric element member.

13. A method of manufacturing the liquid jet head claimed in claim 1, the method comprising a step of:

arranging the plural piezoelectric element units at predetermined intervals by placing a gap defining member between the adjacent piezoelectric element units.

14. A method of manufacturing the liquid jet head claimed in claim 1, wherein the piezoelectric elements of the piezoelectric element units are bonded to the vibration plate member unit by unit.

15. An image forming apparatus for forming images by jetting liquid droplets from a liquid jet head, the image forming apparatus comprising:

the liquid jet head as claimed in claim 1.

16. The liquid jet head as claimed in claim 1, wherein a space separates the base members of respective adjacent ones of the piezoelectric element units.

* * * * *